US007466325B2

(12) United States Patent
Miyagawa

(10) Patent No.: US 7,466,325 B2
(45) Date of Patent: Dec. 16, 2008

(54) SEMICONDUCTOR DISPLAY DEVICE AND DRIVING METHOD

(75) Inventor: Keisuke Miyagawa, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 760 days.

(21) Appl. No.: 11/130,963

(22) Filed: May 17, 2005

(65) Prior Publication Data

US 2005/0259121 A1 Nov. 24, 2005

(30) Foreign Application Priority Data

May 18, 2004 (JP) ..... 2004-147874
Jun. 25, 2004 (JP) ..... 2004-187673

(51) Int. Cl.
*G09G 5/10* (2006.01)

(52) U.S. Cl. ..... 345/690; 345/60; 345/61; 345/63; 345/68

(58) Field of Classification Search ..... 345/690, 345/60–63, 68
See application file for complete search history.

(56) References Cited

U.S. PATENT DOCUMENTS 6,334,839 B1 * 1/2002 Lim et al. ..... 482/54
6,614,413 B2 9/2003 Tokunaga et al. ..... 345/63
6,778,152 B1 * 8/2004 Huang ..... 345/60
2002/0054000 A1 5/2002 Tokunaga et al. ..... 345/60

FOREIGN PATENT DOCUMENTS

EP 0 952 569 10/1999
JP 2000-231362 8/2000
JP 2004-138783 5/2004

* cited by examiner

*Primary Examiner*—Richard Hjerpe
*Assistant Examiner*—Leonid Shapiro
(74) *Attorney, Agent, or Firm*—Cook Alex Ltd.

(57) ABSTRACT

The invention provides a semiconductor display device with less generation of a pseudo contour while the drive frequency of a driver circuit is suppressed. Furthermore, the invention provides a semiconductor display device with less generation of a pseudo contour while the decrease in image quality is suppressed. A semiconductor display device comprises a table storing data for determining a relationship between the gray scale level of a video signal and a subframe period for light emission in the plurality of subframe periods, a controller for changing a video signal in accordance with the data and outputting, and a panel whose pixel gray scale level is controlled in accordance with the outputted video signal. The number and the length of the plural subframe periods for each gray scale level of 2 or more are determined in accordance with a subframe ratio $R_{SF}$ which is calculated in accordance with a sharing ratio $R_{sh}$ determined by the frame frequency.

22 Claims, 15 Drawing Sheets

SEMICONDUCTOR DISPLAY DEVICE AND DRIVING METHOD

BACKGROUND OF THE INVENTION

1. Field of the Invention

The present invention relates to a semiconductor display device for displaying by a time gray scale method and a driving method thereof.

2. Description of the Related Art

As a driving method of a light emitting device that is one of semiconductor display devices, there is known a time gray scale method in which a light emission period of a pixel in one frame period is controlled with binary voltage of a digital video signal to display a gray scale. Electroluminescent materials are more suitable for a time gray scale method than liquid crystals and the like since the response speed is generally faster. Specifically, when performing display by the time gray scale method, one frame period is divided into a plurality of subframe periods. Then, a pixel emits light or does not emit light according to a video signal in each subframe period. According to the aforementioned structure, the total actual light emission period of a pixel in one frame period can be controlled by a video signal, so that a gray scale can be displayed.

However, in the case of performing display using the time gray scale method, there is a problem in that a pseudo contour may be displayed in a pixel portion depending on the frame frequency. Pseudo counters are unnatural contour lines that are often perceived when the middle gray scale is displayed by the time gray scale method, which is considered to be mainly caused by a variation of the perceptual luminance due to a characteristic of the human sight.

The pseudo contours are classified into a moving image pseudo contour which occurs when a moving image is displayed, and a still image pseudo contour which occurs when a still image is displayed. The moving image pseudo contour occurs as follow: in contiguous frame periods, a subframe period included in the previous frame period and a subframe period included in the present frame period are perceived as one continuous frame period by human eyes. That is, moving image pseudo contours correspond to unnatural bright or dark lines displayed in a pixel portion that are perceived by human eyes since the gray scale level deviates from the gray scale level to be displayed in the actual frame period. A mechanism for generation of a still image pseudo contour is the same as that of a moving image pseudo contour. The still image pseudo contour occurs when a still image is displayed, because a human viewpoint slightly moves horizontally or vertically at a boundary between regions exhibiting the different gray scale levels, and thus a moving image seems to be displayed at pixels in the vicinity of the boundary. That is, still image pseudo contours correspond to unnatural bright or dark lines that occur in a swinging manner in the vicinity of a boundary between regions exhibiting the different gray scale levels due to a moving image pseudo contour occurred at pixels in the vicinity of the boundary.

In order to prevent the above-described pseudo contours, Patent Document 1 has disclosed a driving method of a plasma display, in which a subframe period for light emission appears contiguously within one frame period. According to the driving method, such a phenomenon that a light emission period and a non-light emission period within each frame period are inverted in adjacent frame periods can be prevented, so that a pseudo contour can be suppressed.

[Patent Document 1] Japanese Patent Laid-Open No. 2000-231362 (paragraph 0023)

However, in the driving method disclosed in Patent Document 1, the total gray scale level and the number of subframe periods for one frame period are equal to each other. Therefore, when the number of subframe periods is increased in order to increase the total gray scale level, each subframe period is required to be shortened. However, video signal input to pixels at all rows is generally required in each subframe period. Thus, in the case where the subframe period is too short, the drive frequency of a driver circuit is required to be increased. When considering the reliability of a driver circuit, it is not preferable to make a subframe period shorter than is necessary.

Note that each subframe period can be lengthened to some extent by lengthening a frame period. However, lengthening the frame period is not preferable in that drastic increase of the total gray scale level is not to be realized whereas a pseudo contour is to be more generated.

In Patent Document 1, a technology for increasing the total gray scale level to be displayed in a pseudo manner without increasing the number of subframe periods is also described, in which image processing such as dithering is performed. However, by performing the image processing such as dithering, a large total gray scale level can be displayed while the image is displayed as if sand is spread thereover, leading inevitably to decrease in image quality.

SUMMARY OF THE INVENTION

In view of the foregoing problem, it is an object of the invention to provide a driving method of a semiconductor display device, in which generation of a pseudo contour can be suppressed while suppressing the drive frequency of a driver circuit. In addition, it is an object of the invention to provide a driving method of a semiconductor display device, in which generation of a pseudo contour can be suppressed while suppressing the decrease in image quality.

Further, in view of the foregoing problem, it is an object of the invention to provide a semiconductor display device, in which generation of a pseudo contour can be suppressed while suppressing the drive frequency of a driver circuit. In addition, it is an object of the invention to provide a semiconductor display device, in which generation of a pseudo contour can be suppressed while suppressing the decrease in image quality.

The present inventor found out that the higher the rate of a subframe period for light emission in common in adjacent frame periods before and after the gray scale level is changed by one is, the less a pseudo contour is generated. Therefore, according to the invention, the length rate (sharing ratio) of a subframe period for light emission in common in adjacent frame periods where the gray scale level is different by one is increased to the extent that generation of a pseudo contour can be suppressed, to perform driving.

The sharing ratio can be obtained by comparing a frame period for the specific gray scale level and a frame period for the gray scale level higher than the specific frame period by one with each other.

The minimum sharing ratio for obtaining an effect of suppressing a pseudo contour can be obtained by the frame frequency. With the sharing ratio and the total gray scale level to be displayed, the length of each subframe period, and a subframe period for light emission in displaying each of the gray scales can be calculated.

In a driving method of the invention, in accordance with a sharing ratio $R_{sh}$ determined by the frame frequency, a subframe ratio $R_{SF}$ is calculated. The number and the length of a plurality of subframe periods within one frame period for each gray scale level of 2 or more, and a subframe period for light emission in the plurality of subframe periods are determined so as to fulfill the subframe ratio $R_{SF}$.

A light emitting device of the invention comprises a table storing data for determining in accordance with a subframe ratio $R_{SF}$, the number and the length of a plurality of subframe periods within one frame period for each gray scale level of 2 or more and a subframe period for light emission in the plurality of subframe periods, a controller for changing in accordance with the data, the number of bits of a video signal and data of each bit, and a panel whose pixel gray scale level is controlled in accordance with the video signal after being changed. The subframe ratio $R_{SF}$ is calculated in accordance with a sharing ratio $R_{sh}$ determined by the frame frequency.

It is to be noted that, in this specification, light emitting elements include an element of which luminance is controlled by current or voltage, specifically such as an OLED (Organic Light Emitting Diode), a MIM type electron source element (electron emitting element) used in an FED (Field Emission Display).

An OLED, which is a light emitting element, includes a layer containing an electroluminescent material (hereinafter, referred to as an "electroluminescent layer") that can generate luminescence (Electroluminescence) when an electric field is applied thereto, an anode, and a cathode. The electroluminescent layer is provided between the anode and the cathode, and structured by a single layer or a plurality of layers. These layers may contain an inorganic compound. Luminescence in the electroluminescent layer includes luminescence (fluorescence) generated when returning to a ground state from a singlet excitation state, and luminescence (phosphorescence) generated when returning to a ground state from a triplet excitation state.

A semiconductor display device of the invention includes a light emitting device providing a light emitting element typified by an organic light emitting element (OLED) in each pixel, a liquid crystal display device, a DMD (Digital Micromirror Device), a PDP (Plasma Display Panel), an FED (Field Emission Display), and other display devices capable of displaying by a time gray scale method.

In addition, the light emitting device includes a panel with a light emitting element sealed, and a module where an IC and the like including a controller are mounted on the panel.

As a transistor in the light emitting device of the invention, a thin film transistor using a polycrystalline semiconductor, a microcrystalline semiconductor (including a semi-amorphous semiconductor), or an amorphous semiconductor can be used; however, the transistor in the light emitting device of the invention is not limited to a thin film transistor. A transistor using single crystalline silicon or a transistor employing an SOI may be used. Alternatively, a transistor using an organic semiconductor or a carbon nanotube may be used. Furthermore, a transistor provided in a pixel of the light emitting device of the invention may have a single-gate structure, a double-gate structure, or a multi-gate structure having more than two gates.

A semi-amorphous semiconductor has an intermediate structure between amorphous and crystalline (including single crystalline and polycrystalline) structures. The semi-amorphous semiconductor has a third state that is stable in terms of free energy, and has a short range order and a lattice distortion, in which crystals having a particle size of 0.5 to 20 nm can be dispersed in a non-single crystalline semiconductor. In the semi-amorphous semiconductor, Raman spectrum is shifted to the lower frequency band than 520 $cm^{-1}$ and diffraction peaks of (111) and (220) believed to be derived from a Si crystal lattice are observed by X-ray diffraction. Further, the semiconductor is mixed with hydrogen or halogen of at least 1 atom % for terminating the dangling bond. Such a semiconductor is called herein a semi-amorphous semiconductor (SAS) for convenience. A favorable semi-amorphous semiconductor with improved stability can be obtained by further promoting the lattice distortion by mixing rare-gas elements such as helium, argon, krypton, and neon.

According to the above-described structure of the invention, the total gray scale level and the number of subframe periods are not required to be equal to each other unlike a conventional structure, display can be performed with a high total gray scale level while suppressing the number of subframes. Consequently, the total gray scale level can be increased without performing processing such as dithering that decreases image quality.

In addition, driving is performed so as to fulfill a sharing ratio higher than a required value, so that a pseudo contour can be prevented while suppressing the frame frequency and the drive frequency of a driver circuit.

DETAILED DESCRIPTION OF THE INVENTION

Although the invention will be fully described by way of embodiment mode and embodiments with reference to the accompanying drawings, it is to be understood that various changes and modifications will be apparent to those skilled in the art. Therefore, unless such changes and modifications depart from the scope of the invention, they should be construed as being included therein.

Figure 1:
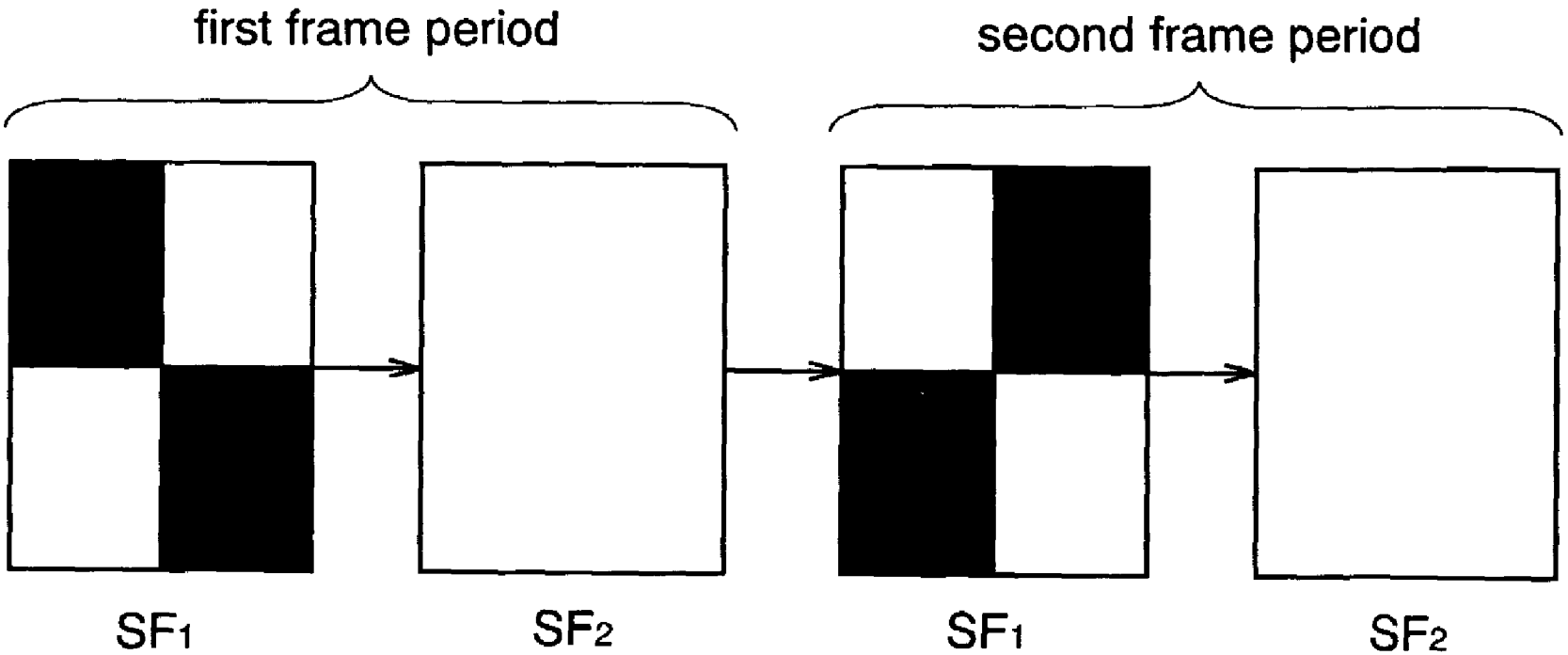
FIG. 1 is patterns used for displaying in an experiment to look into a relationship between the sharing ratio and generation of a pseudo contour.

The inventor conducted the following experiment to look into a relationship between the sharing ratio and generation of a pseudo contour. First, one frame period is divided into two subframe periods $SF_1$ and $SF_2$, and patterns shown in FIG. 1 are displayed in a first frame period and a second frame period. Specifically, a checkered pattern is displayed in the subframe period $SF_1$ and white is displayed in the entire region in the subframe period $SF_2$. Note that the pattern displayed in the subframe period $SF_1$ is inverted with respect to a white region and a black region in the first frame period and the second frame period. Then, the two frame periods are set to appear alternatively. In this manner, generation of a pseudo contour was inspected.

Figure 2:
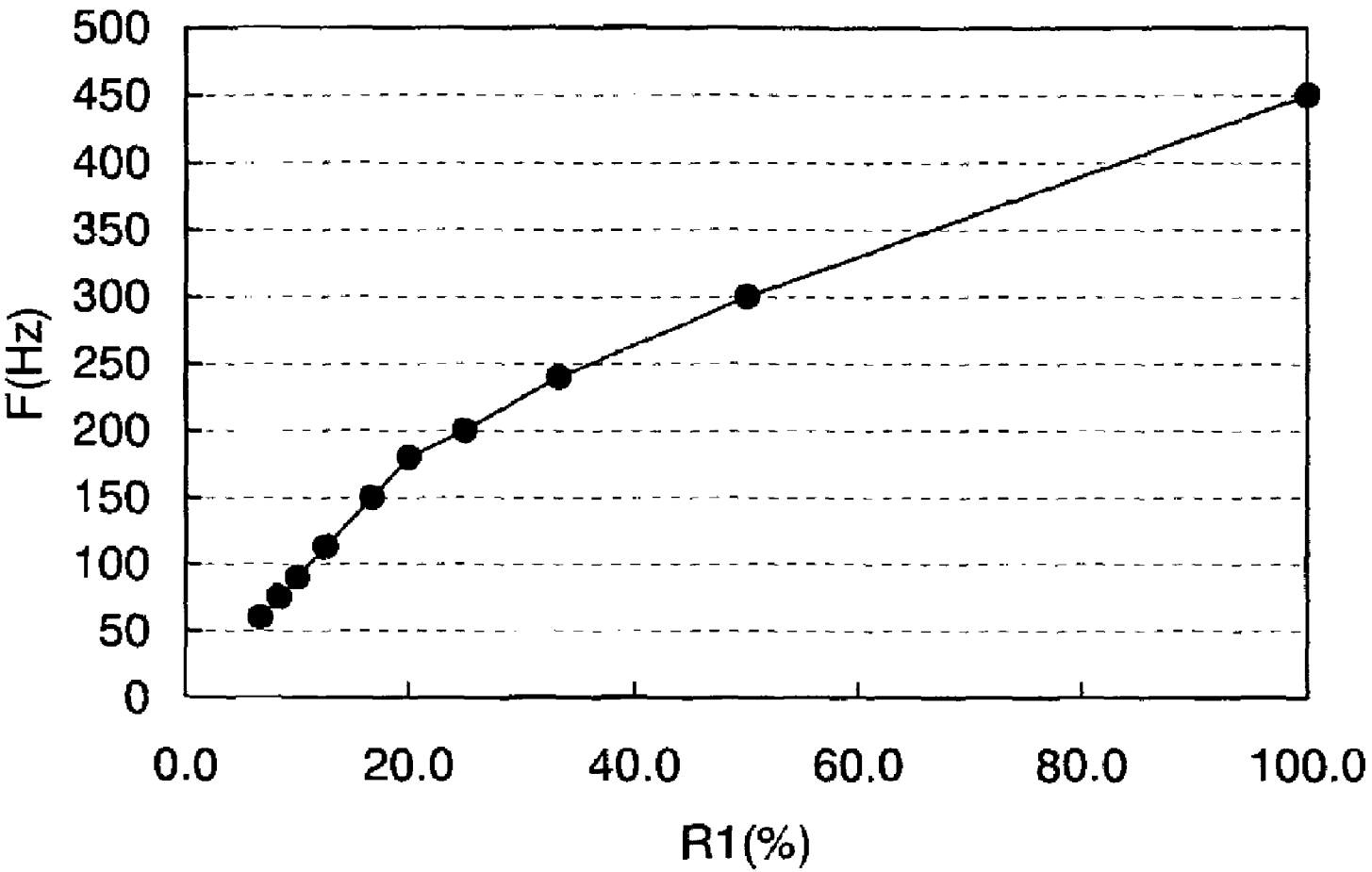
FIG. 2 is a graph showing a relationship between $R_1$ (%), which denotes a rate of a subframe period $SF_1$ in one frame period, and the minimum frame frequency F (Hz) with which generation of a pseudo contour is perceived.

When a rate of the subframe period $SF_1$ within one frame period is denoted by $R_1$ (%), $R_1$ (%) and the minimum frame frequency F (Hz) with which generation of a pseudo contour is perceived has a relationship shown in FIG. 2. As shown in FIG. 2, the lower $R_1$ (%) is, the lower the minimum frame frequency F (Hz) with which generation of a pseudo contour is perceived is. To the contrary, the higher $R_1$ (%) is, the higher the minimum frame frequency F (Hz) with which generation of a pseudo contour is perceived is.

In other words, the shorter the subframe period $SF_1$, where display at each pixel is changed for each frame period, is, the less a pseudo contour is generated. The longer the subframe period $SF_2$, where display at each pixel is the same in adjacent frame periods, is, the less a pseudo contour is generated. According to the above-described experimental result, it is found that the higher the rate (sharing ratio) of a subframe period for light emission in common in adjacent frame periods is, the more generation of a pseudo contour can be suppressed.

Figure 14A:
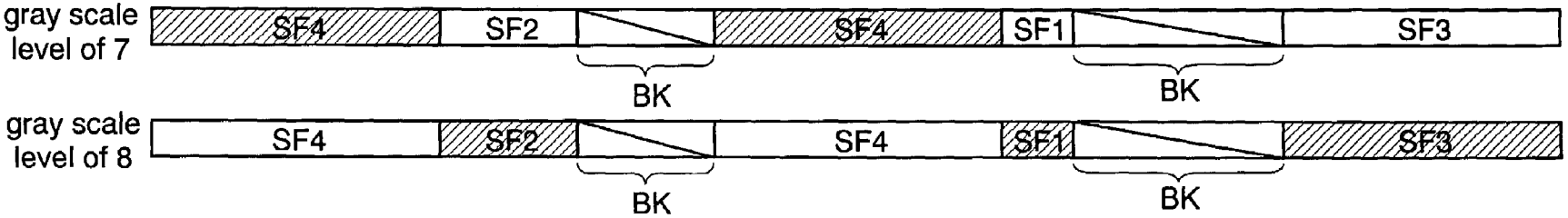
FIG. 14A is a comparative diagram of a conventional subframe period structure and FIG. 14B is a diagram of a subframe period structure of the invention.
Figure 14B:
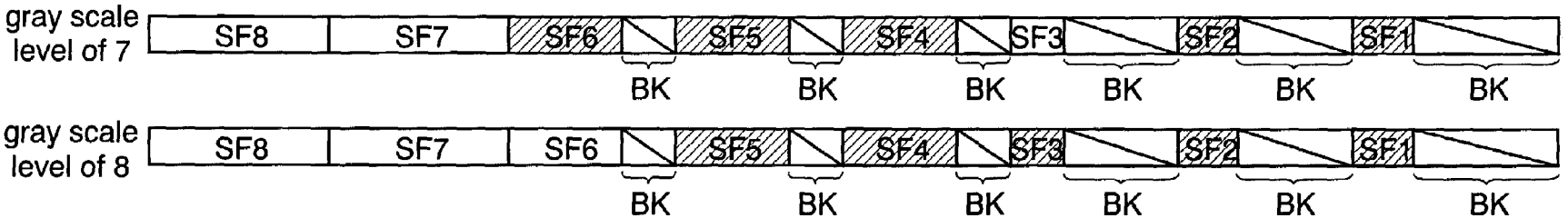

FIGS. 14A and 14B show examples of a subframe period structure employed in an actual light emitting device. FIG. 14A shows a subframe period structure for a gray scale level of 7 and a subframe period structure for a gray scale level of 8 in the case of displaying with the total gray scale level of $2^4$. In FIG. 14A, four subframe periods $SF_1$ to $SF_4$ are employed, and the subframe period $SF_4$ is further divided into two. The ratio of the subframe periods $SF_1$ to $SF_4$ is set to be SF1:SF2:SF3:SF4=1:2:4:8. It is to be noted that a period BK corresponds to a period for forcibly making a light emitting element emit no light (non-display period), which makes no contribution to the gray scale level.

In FIG. 14A, in the case of displaying 7 gray scales, subframe periods for light emission are $SF_1$, $SF_2$, and $SF_3$, and a subframe period for non-light emission is $SF_4$. In the case of displaying 8 gray scales in FIG. 14A, a subframe period for light emission is $SF_4$, and subframe periods for non-light emission are $SF_1$, $SF_2$, and $SF_3$. Therefore, there is no subframe period for light emission in common, so that the sharing ratio is 0%. According to the subframe period structures shown in FIG. 14A, a pseudo contour tends to be generated.

Next, FIG. 14B shows subframe period structures, which differ from those shown in FIG. 14A. FIG. 14B shows a subframe period structure for the gray scale level of 7 and a subframe period structure for the gray scale level of 8 in the case of displaying with the total gray scale level of $2^4$ similarly to FIG. 14A. In FIG. 14B, 8 subframe periods $SF_1$ to $SF_8$ are employed. The ratio of the subframe periods $SF_1$ to $SF_8$ is set to be SF1:SF2:SF3:SF4:SF5:SF6:SF7:SF8=1:1:1:2:2:2:3:3. It is to be noted that a period BK corresponds to a period for non-display period, which makes no contribution to the gray scale level.

In FIG. 14B, in the case of displaying 7 gray scales, subframe periods for light emission are $SF_3$, $SF_7$, and $SF_8$, and subframe periods for non-light emission are $SF_1$, $SF_2$, $SF_4$, $SF_5$, and $SF_6$. In the case of displaying 8 gray scales in FIG. 14B, subframe periods for light emission are $SF_6$, $SF_7$, and $SF_8$, and subframe periods for non-light emission are $SF_1$, $SF_2$, $SF_3$, $SF_4$, and $SF_5$. Therefore, subframe periods for light emission in common are $SF_7$ and $SF_8$, so that the sharing ratio is 75% that is obtained by $(SF_7+SF_8)\times 100/(SF_7+SF_8+SF_6)$. According to the subframe period structures shown in FIG. 14B, a pseudo contour is less generated than the case shown in FIG. 14A.

A method of determining the length of each subframe period within one frame period by the sharing ratio $R_{sh}$ and the total gray scale level in order to perform a driving method of the invention is described below in detail.

First, the sharing ratio $R_{sh}$ is calculated based on the frame frequency employed for driving. A pseudo contour is less generated in the case of a high frame frequency, while it is more generated in the case of a low frame frequency. Thus, by determining the frame frequency in advance, the minimum sharing ratio for suppressing generation of a pseudo contour can be determined for each light emitting device.

Figure 3:
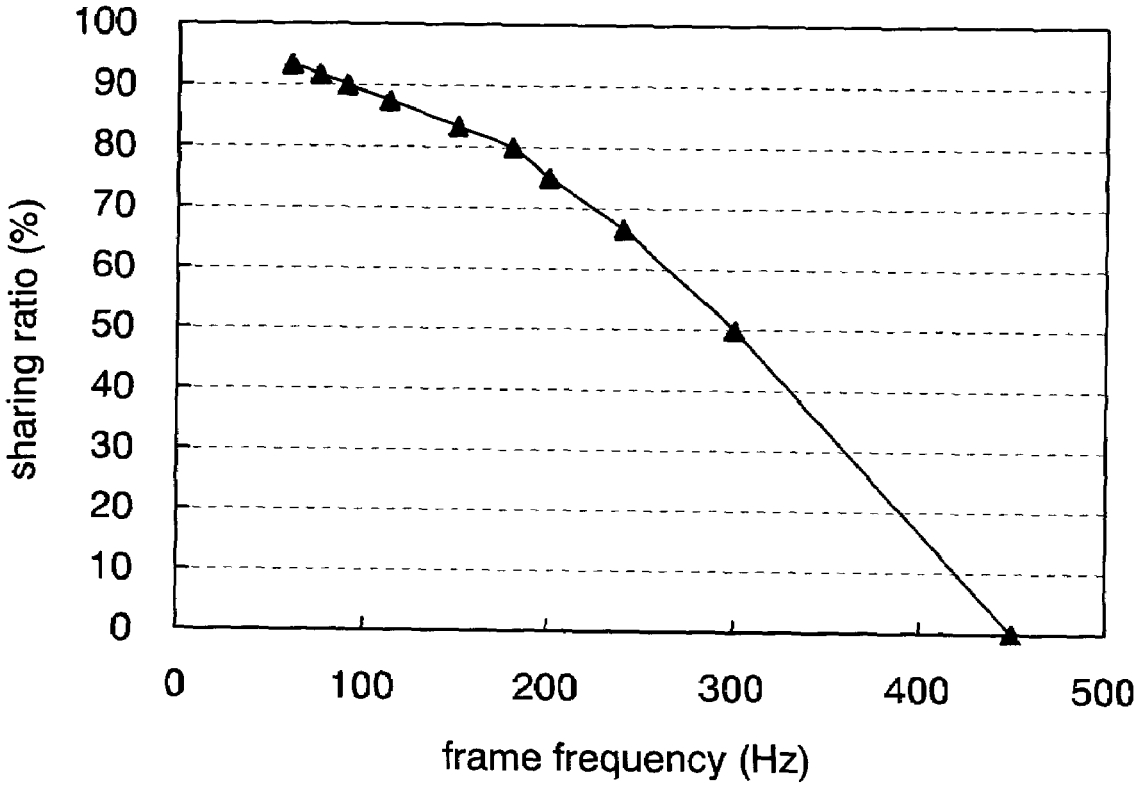
FIG. 3 is a graph showing a relationship between the frame frequency (Hz) and the minimum sharing ratio (%) for suppressing generation of a pseudo contour.

FIG. 3 shows an example of a relationship between the frame frequency (Hz) and the minimum sharing ratio (%) for suppressing generation of a pseudo contour. It is to be noted that the sharing ratio (%) is denoted by 100 (%)−$R_1$ (%). The lower the sharing ratio is, the higher frame frequency is required for suppressing generation of a pseudo contour as shown in FIG. 3. Note that the criterion for judging whether a pseudo contour is generated or not can be determined arbitrarily; therefore, the same relationship as that shown in FIG. 3 is not necessarily obtained. Under a certain predetermined criterion for judgment, however, a relationship between the frame frequency (Hz) and the minimum sharing ratio (%) for suppressing generation of a pseudo contour results in that the higher the frame frequency is, the more generation of a pseudo contour can be suppressed.

From the graph shown in FIG. 3, at a specific frame frequency, the minimum sharing ratio (%) for suppressing generation of a pseudo contour is obtained, thereby a sharing ratio $R_{sh}$ whose value is equal to or more than the minimum sharing ratio can be determined. With the sharing ratio $R_{sh}$ determined, the length of each subframe period is determined.

First, n subframe periods for one frame period are referred to as $SF_1$ to $SF_n$ in ascending order of length. It is assumed here that when light emission is performed in all of $SF_1$ to $SF_p$ (p<n), m gray scales ($m<2^n$) can be displayed. In this case, when $T_m$ denotes the total length of the subframe periods $SF_1$ to $SF_p$ for light emission in displaying m gray scales, $T_m$ can be obtained by the following Formula 1.

$$T_m = \sum_{n=1}^{p} SF_n \qquad \text{[Formula 1]}$$

Next, the case of displaying (m+1) gray scales is considered. Since m gray scales can be displayed by emitting light in all of $SF_1$ to $SF_p$, it is necessary to employ $SF_{p+1}$ which is longer than $SF_p$ in order to display (m+1) gray scales. At the same time, it is necessary to subtract one or a plurality of subframe periods from $SF_1$ to $SF_p$ to display, corresponding to the length obtained by subtracting the length for one gray scale (e.g., the length corresponding to $SF_1$) from $SF_{p+1}$. Consequently, when $T_{m+1}$ denotes the total length of subframe periods for light emission in displaying (m+1) gray scales, $T_{m+1}$ can be obtained by the following Formula 2.

$$T_{m+1} = \sum_{n=1}^{p+1} SF_n - (SF_{p+1} - SF_1) \quad \text{[Formula 2]}$$

In addition, when the subframe ratio $R_{SF}$ denotes the rate of $SF_{p+1}$ in the sum of the subframe periods $SF_1$ to $SF_{p+1}$, $R_{SF}$ can be obtained by the following Formula 3.

$$R_{SF} = \frac{SF_{p+1}}{\sum_{n=1}^{p+1} SF_n} \quad \text{[Formula 3]}$$

The following Formula 4 can be derived from Formula 3.

$$SF_{p+1} = \sum_{n=1}^{p+1} SF_n \times R_{SF} \quad \text{[Formula 4]}$$

In addition, when $W_{m/m+1}$ denotes the total length of subframe periods for light emission in common in displaying m gray scales and in displaying (m+1) gray scales, $W_{m/m+1}$ can be obtained by the following Formula 5.

$$W_{m/m+1} = T_m - (SF_{p+1} - SF_1) \quad \text{[Formula 5]}$$

Accordingly, the following Formula 6 is derived from Formula 1, Formula 4, and Formula 5.

$$\begin{aligned} W_{m/m+1} &= \sum_{n=1}^{p} SF_n - (SF_{p+1} - SF_1) \\ &= \sum_{n=1}^{p+1} SF_n - SF_{p+1} - (SF_{p+1} - SF_1) \\ &= \sum_{n=1}^{p+1} SF_n - 2 \times R_{SF} \times \sum_{n=1}^{p+1} SF_n + SF_1 \end{aligned} \quad \text{[Formula 6]}$$

The sharing ratio $R_{sh}$ of subframe periods for light emission in common in displaying m gray scales and in displaying (m+1) gray scales is obtained by the following Formula 7.

$$R_{sh} = W_{m/m+1} / T_{m+1} \quad \text{[Formula 7]}$$

Accordingly, the following Formula 8 is derived from Formula 2, Formula 4, Formula 6, and Formula 7.

$$R_{sh} = \left\{ \sum_{n=1}^{p+1} SF_n - 2 \times R_{SF} \times \sum_{n=1}^{p+1} SF_n + SF_1 \right\} \Big/ \quad \text{[Formula 8]}$$

-continued $$\left\{ \sum_{n=1}^{p+1} SF_n - R_{SF} \times \sum_{n=1}^{p+1} SF_n + SF_1 \right\}$$

$$\approx \left\{ \sum_{n=1}^{p+1} SF_n - 2 \times R_{SF} \times \sum_{n=1}^{p+1} SF_n \right\} \Big/ \left\{ \sum_{n=1}^{p+1} SF_n - R_{SF} \times \sum_{n=1}^{p+1} SF_n \right\}$$

$$= (1 - 2R_{SF}) / (1 - R_{SF})$$

Accordingly, the following Formula 9 can be derived from Formula 8.

$$R_{SF} = (1 - R_{sh}) / (2 - R_{sh}) \quad \text{[Formula 9]}$$

Consequently, a value of the subframe ratio $R_{SF}$ can be obtained by substituting a value of the sharing ratio $R_{sh}$ into Formula 9. The subframe ratio $R_{SF}$ is the rate of $SF_{p+1}$ in the sum of the subframe periods $SF_1$ to $SF_{p+1}$. By using the aforementioned subframe ratio $R_{SF}$, the length of each subframe period can be determined sequentially from the longest subframe period $SF_n$.

Note that the constant subframe ratio $R_{SF}$ is applied to all of $SF_n$ to $SF_1$ respectively in this embodiment mode, however, the invention is not limited to this structure. For example, the number of subframe periods is not necessarily limited to n in the case of the total gray scale level of $2^n$. When the length calculated following Formula 9 is applied to each subframe period, the number of subframe periods results in more than n in many cases. However, as for a short subframe period for displaying a low gray scale, it does not affect so much generation of a pseudo contour even if the aforementioned value of the sharing ratio $R_{sh}$ is not fulfilled. The reason is as follow: in the case of a low gray scale level, a value (the rate of a gray scale level) of a reciprocal of the gray scale level×100 is larger than the case of a high gray scale level. Therefore, a contour due to a difference between gray scale levels is perceived, which makes a pseudo contour to be less perceived.

Figure 13:
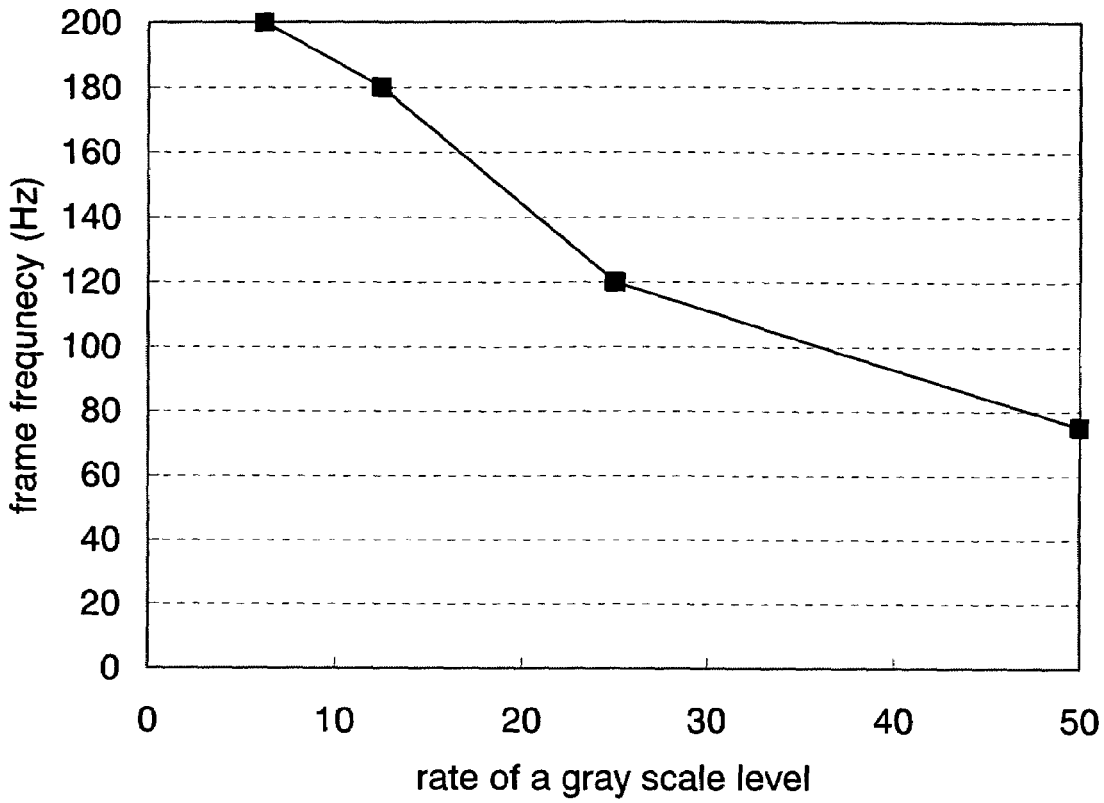
FIG. 13 is a graph showing a relationship between the rate of a gray scale level and the minimum frame frequency F (Hz) with which generation of a pseudo contour is perceived.

FIG. 13 is a graph showing a relationship between the rate of a gray scale level (%) and the minimum frame frequency F (Hz) with which generation of a pseudo contour is perceived. In FIG. 13, the horizontal axis indicates the rate of a gray scale level (%), and the vertical axis indicates the minimum frame frequency F (Hz) with which generation of a pseudo contour is perceived. It is turned out from FIG. 13 that the higher the rate of a gray scale level (%) is, that is, the lower the gray scale level is, the lower the frame frequency where generation of a pseudo contour can be suppressed is.

Therefore, a short subframe period is preferably decreased in number to place the full weight of decrease of the drive frequency of a drier circuit, rather than providing many subframe periods having no effect on generation of a pseudo contour. Specifically, for calculation, when a plurality of short subframe periods each corresponding to 1 gray scale are provided, one or several of them are thinned out.

Specifically, the total gray scale level is divided equally among three, and a value of the sharing ratio $R_{sh}$ is not necessarily required to be fulfilled in the lowest gray scale group among them. To the contrary, the value of the sharing ratio $R_{sh}$ is fulfilled in the middle and the highest gray scale groups among them. For example, in the case where the total gray scale level is $2^6$=64, the gray scale level of 0 to 63 is divided equally among three, resulting in 21. In this case, the lowest gray scale level is 0 to 21, the middle gray scale level is 22 to 42, and the highest gray scale level is 43 to 63. Note that in the case where the total gray scale level cannot be divided equally among three, a fraction may be rounded up or down.

Figure 4:
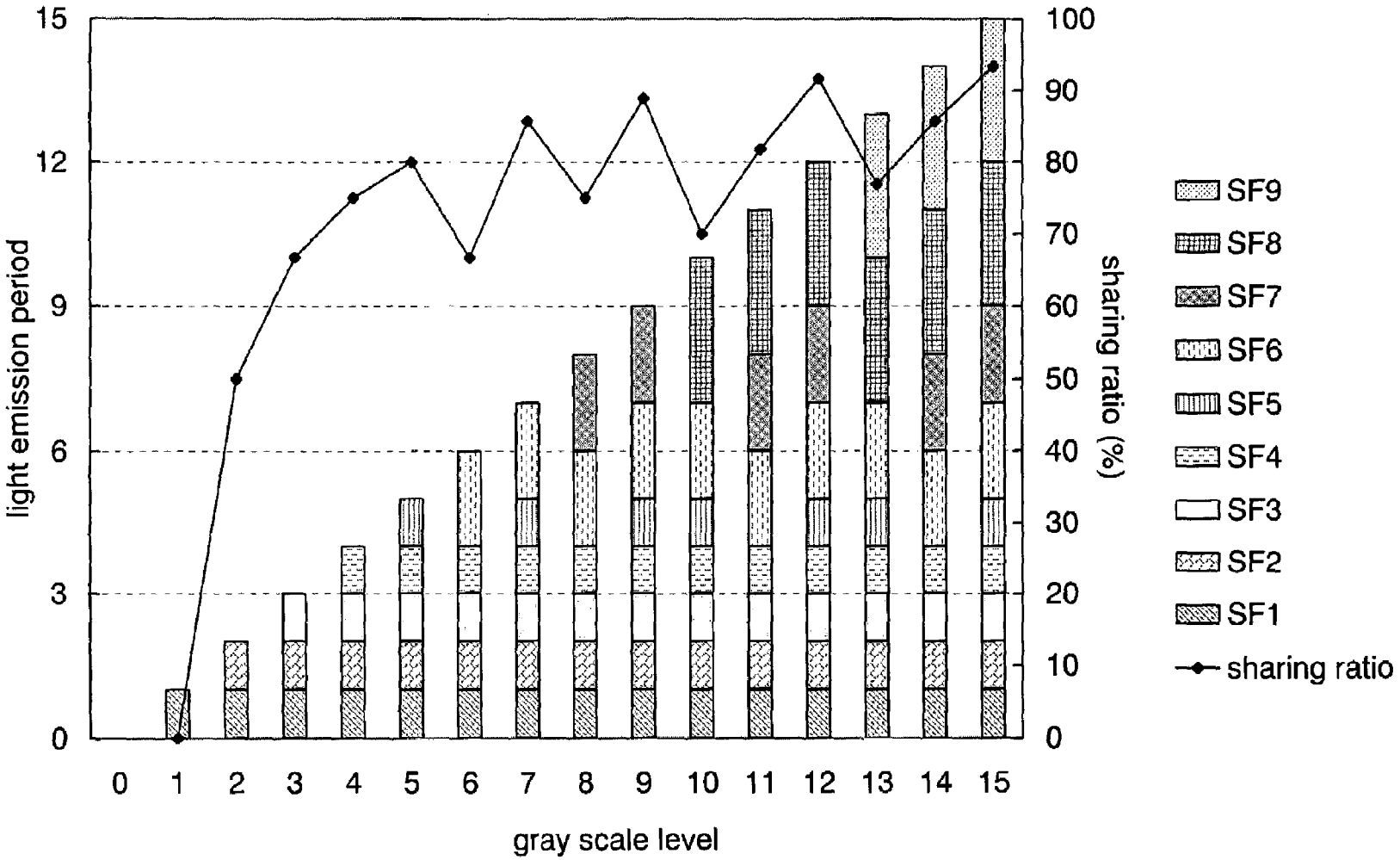
FIG. 4 is a graph showing a relationship between the gray scale level and a subframe period for light emission, and a sharing ratio $R_{sh}$ (%) obtained by comparing with the case of a lower gray scale level by one.

FIG. 4 shows a relationship between the gray scale level and a subframe period for light emission in the case where display is performed with the total gray scale level of $2^4$ using a 4-bit video signal. In FIG. 4, the horizontal axis indicates the gray scale level, and the left vertical axis indicates the total length of a subframe period for light emission (light emission period). The gray scale level to display is determined by the length for light emission. At the same time, in FIG. 4, the right vertical axis indicates the sharing ratio $R_{sh}$ (%) obtained by comparing with the case for a lower gray scale level by one. Note that in FIG. 4, 9 subframe periods $SF_1$ to $SF_9$ are employed to perform display. The length ratio of the 9 subframe periods $SF_1$ to $SF_9$ is set to be 1:1:1:1:1:2:2:3:3 sequentially from $SF_1$.

In FIG. 4, the length of each subframe period is determined such that the sharing ratio $R_{sh}$ (%) is kept at 65% or more in the case where gray scales from 3 to 15 are displayed. It is to be noted that the sharing ratio $R_{sh}$ (%) is not fulfilled in the gray scale level of 0 and 1 by definition of the sharing ratio $R_{sh}$ (%). In addition, in the low gray scale level of 2, the sharing ratio $R_{sh}$ (%) is not fulfilled in FIG. 4. However, in the low gray scale level, where a pseudo contour is less generated, the sharing ratio $R_{sh}$ (%) is not necessarily required to be fulfilled.

Figure 15:
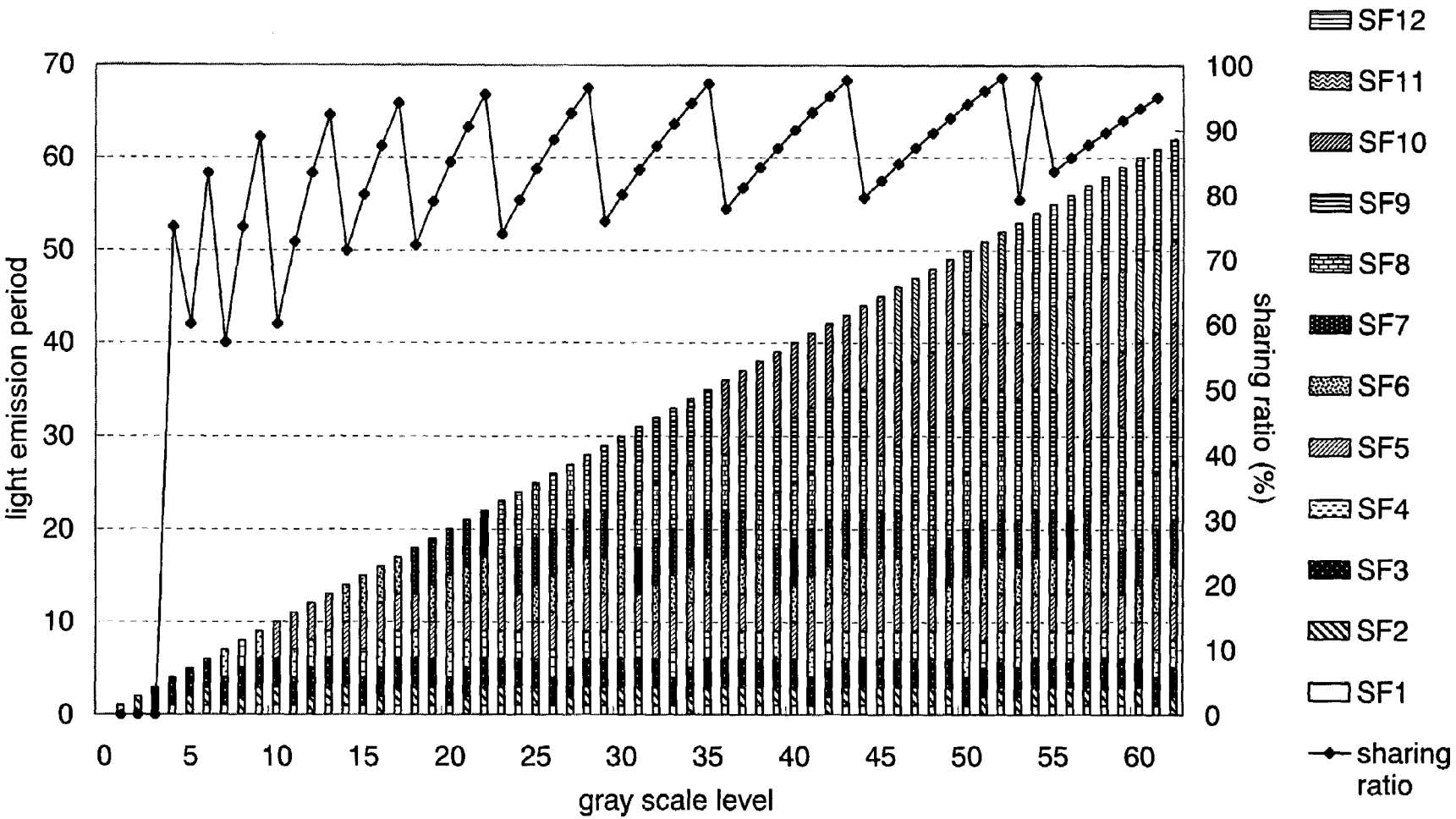
FIG. 15 is a graph showing a relationship between the gray scale level and a subframe period for light emission, and a sharing ratio $R_{sh}$ (%) obtained by comparing with the case for a lower gray scale level by one.

FIG. 15 shows a relationship between the gray scale level and a subframe period for light emission in the case where display is performed with the total gray scale level of $2^6$ using a 6-bit video signal. In FIG. 15, the horizontal axis indicates the gray scale level, and the left vertical axis indicates the total length of a subframe period for light emission (light emission period). The gray scale level to display is determined by the length for light emission. At the same time, in FIG. 15, the right vertical axis indicates the sharing ratio $R_{sh}$ (%) obtained by comparing with the case for a lower gray scale level by one. Note that in FIG. 15, 12 subframe periods $SF_1$ to $SF_{12}$ are employed to perform display. The length ratio of the 12 subframe periods $SF_1$ to $SF_{12}$ is set to be 1:2:3:3:4:4:5:6:7:8:9:11 sequentially from $SF_1$.

In FIG. 15, the length of each subframe period is determined such that the sharing ratio $R_{sh}$ (%) is kept at 70% or more in the case where gray scales from 12 to 63 are displayed. It is to be noted that the sharing ratio $R_{sh}$ (%) is not fulfilled in the gray scale level of 0 and 1 by definition of the sharing ratio $R_{sh}$ (%). In addition, in the low gray scale levels from 2 to 11, the sharing ratio $R_{sh}$ (%) is not fulfilled in FIG. 15. However, in the low gray scale level, where a pseudo contour is less generated, the sharing ratio $R_{sh}$ (%) is not necessarily required to be fulfilled.

According to a driving method of the invention, whether light emission or non-light emission is controlled for each subframe period by referring to a table in which a relationship between the gray scale level of a video signal and a subframe period for light emission is determined. Table 1 shows a relationship between the gray scale level of a video signal and each subframe period for light emission and for non-light emission in the case of FIG. 4.

TABLE 1

| bit | gray scale level | $SF_1$ | $SF_2$ | $SF_3$ | $SF_4$ | $SF_5$ | $SF_6$ | $SF_7$ | $SF_8$ | $SF_9$ |
|---|---|---|---|---|---|---|---|---|---|---|
| 0000 | 0 | X | X | X | X | X | X | X | X | X |
| 0001 | 1 | ○ | X | X | X | X | X | X | X | X |
| 0010 | 2 | ○ | ○ | X | X | X | X | X | X | X |
| 0011 | 3 | ○ | ○ | ○ | X | X | X | X | X | X |
| 0100 | 4 | ○ | ○ | ○ | ○ | X | X | X | X | X |
| 0101 | 5 | ○ | ○ | ○ | ○ | ○ | X | X | X | X |
| 0110 | 6 | ○ | ○ | ○ | ○ | X | ○ | X | X | X |
| 0111 | 7 | ○ | ○ | ○ | ○ | ○ | ○ | X | X | X |
| 1000 | 8 | ○ | ○ | ○ | ○ | X | ○ | ○ | X | X |
| 1001 | 9 | ○ | ○ | ○ | ○ | ○ | ○ | ○ | X | X |
| 1010 | 10 | ○ | ○ | ○ | ○ | ○ | ○ | X | ○ | X |
| 1011 | 11 | ○ | ○ | ○ | ○ | X | ○ | ○ | ○ | X |
| 1100 | 12 | ○ | ○ | ○ | ○ | ○ | ○ | ○ | ○ | X |
| 1101 | 13 | ○ | ○ | ○ | ○ | ○ | ○ | X | ○ | ○ |
| 1110 | 14 | ○ | ○ | ○ | ○ | X | ○ | ○ | ○ | ○ |
| 1111 | 15 | ○ | ○ | ○ | ○ | ○ | ○ | ○ | ○ | ○ |

Table 1 is a table showing a relationship between a 4-bit video signal and 9 subframe periods. In accordance with the table, whether light emission or non-light emission is controlled for each of the subframe periods $SF_1$ to $SF_9$. In Table 1, "o" denotes light emission and "x" denotes non-light emission. In this manner, according to the invention, a video signal is converted in accordance with data shown in Table 1, and the converted video signal is used to perform display.

Note that a light emitting device performing the aforementioned driving method of the invention comprises a table for outputting a signal predetermined with respect to an inputted signal. The table is structured by hardware including a memory such as a ROM and a RAM, which stores data shown as Table 1 for example. Of course, data of the table is not limited to that shown in Table 1, and can be set arbitrarily depending on the total gray scale level of an image to be displayed, and the number and the length of subframe periods.

Figure 5A:
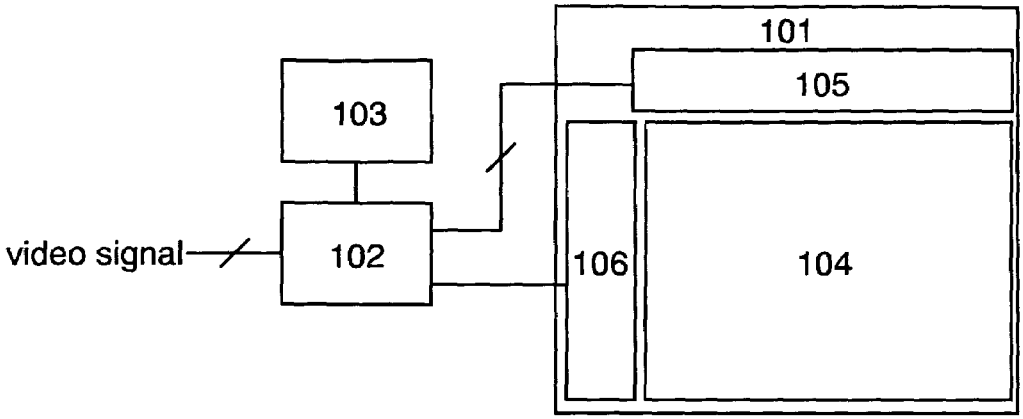
FIGS. 5A and 5B are block diagrams showing constitution of the light emitting device of the invention.

Next, specific constitution of a light emitting device of the invention is described. FIG. 5A is a block diagram of exemplary constitution of a light emitting device of the invention. The light emitting device shown in FIGS. 5A and 5B comprises a panel 101, a controller 102, and a table 103. The panel 101 comprises a pixel portion 104 including a plurality of pixels each having a light emitting element, a signal line driver circuit 105, and a scan line driver circuit 106.

The table 103 is structured by hardware including a memory such as a ROM and a RAM. The memory stores data for determining the number and the length of a plurality of subframe periods for one frame period, and a subframe period for light emission in the case for each gray scale level in the plurality of subframe periods in accordance with the subframe ratio $R_{SF}$. The subframe ratio $R_{SF}$ is calculated following the sharing ratio $R_{sh}$ determined from the frame frequency.

The controller 102 can determine a subframe period for light emission depending on the gray scale level of an inputted video signal, in accordance with data stored in the table 103. Specifically, according to Table 1 for example, subframe periods for light emission are $SF_1$ to $SF_6$, and $SF_8$ when the gray scale level of the video signal is 10. In addition, the controller 102 has a frame memory, and can generate various control signals such as a clock signal and a start pulse signal depending on the each length of a plurality of subframe periods stored in the table 103, the drive frequency of the signal line driver circuit 105 and the scan line driver circuit 106, and the like.

It is to be noted that video signal conversion and control signal generation are both performed by the controller 102 in FIG 5A, however, the invention is not limited to this constitution. A controller for converting a video signal and a controller for generating a control signal may be provided separately in the light emitting device.

Figure 5B:
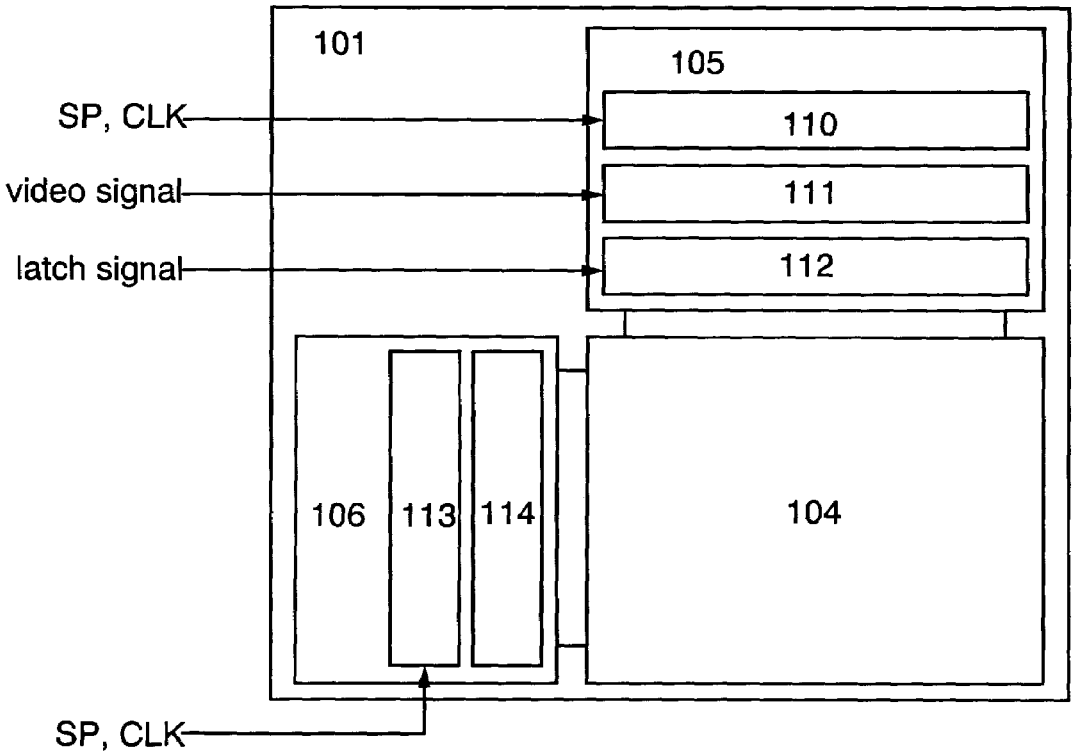

FIG. 5B is an exemplary specific constitution of the panel 101 shown in FIG. 5A.

In FIG. 5B, the signal line driver circuit 105 includes a shift register 110, a latch A 111, and a latch B 112. Control signals such as a clock signal (CLK) and a start pulse signal (SP) are inputted into the shift register 110. When the clock signal (CLK) and the start pulse signal (SP) are inputted, a timing signal is generated in the shift register 110. The generated timing signal is inputted into the first-stage latch A 111 sequentially. When input of the timing signal into the latch A 111 is completed, a video signal being inputted from the controller 102 is sequentially inputted into the latch A 111 in synchronization with a pulse of the inputted timing signal, and held. It is to be noted that the video signal is inputted into the latch A 111 sequentially in this embodiment mode, however, the invention is not limited to this structure. Alternatively, division drive, that is, to divide a plurality of stages of the latch A 111 into several groups and input a video signal in parallel per group may be performed. Note that the number of the groups here is called the dividing number. For example, when the latch is divided into four groups of stages, four-division drive is performed.

The period for completing video signal input into all of the latch stages of the latch A 111 is called a row selection period. Practically, there may be a case where a row selection period includes a horizontal retrace period in addition to the aforementioned row selection period.

One row selection period terminates, and then a latch signal (Latch Signal) that is one of a control signal is supplied to the second-stage latch B 112. In synchronization with the latch signal, the video signal held in the latch A 111 is written all at once into the latch B 112. When sending of the video signal to the latch B 112 terminates, the latch A 111 is sequentially inputted with a video signal of the next bit in synchronization with the timing signal from the shift register 110 again. During second one row selection period, the video signal written and held in the latch B 112 is inputted into the pixel portion 104.

It is to be noted that instead of the shift register 110, a circuit such as a decoder which is capable of selecting a signal line may be used.

Next, constitution of the scan line driver circuit 106 is described. The scan line driver circuit 106 includes a shift register 113 and a buffer 114. Further, a level shifter may be included if necessary. In the scan line driver circuit 106, a clock signal (CLK) and a start pulse signal (SP) are inputted into the shift register 113 to generate a selection signal. The generated selection signal is amplified in the buffer 114 to be supplied to the corresponding scan line. Since the selection signal supplied to the scan line controls operation of transistors included in pixels for one row, a buffer that a relatively large amount of current can be supplied to a scan line is preferably used as the buffer 114.

It is to be noted that instead of the shift register 113, a circuit such as a decoder which is capable of selecting a signal line may be used.

The scan line driver circuit 106 and the signal line driver circuit 105 may be formed over the same substrate as the pixel portion 104, or formed over a different substrate in this invention. Constitution of the panel in the light emitting device of the invention is not limited to that shown in FIG. 5A or FIG. 5B so long as the panel 101 has such constitution that the pixel gray scale level is controlled in accordance with a video signal inputted from the controller 102.

Embodiment 1

Figure 6A:
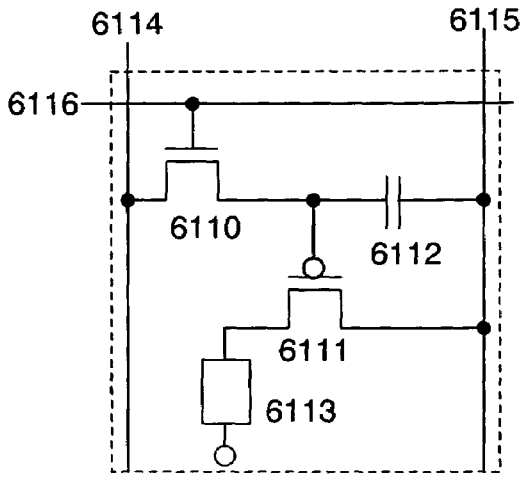
FIGS. 6A to 6C are diagrams showing examples of a pixel in the light emitting device of the invention.
Figure 6B:
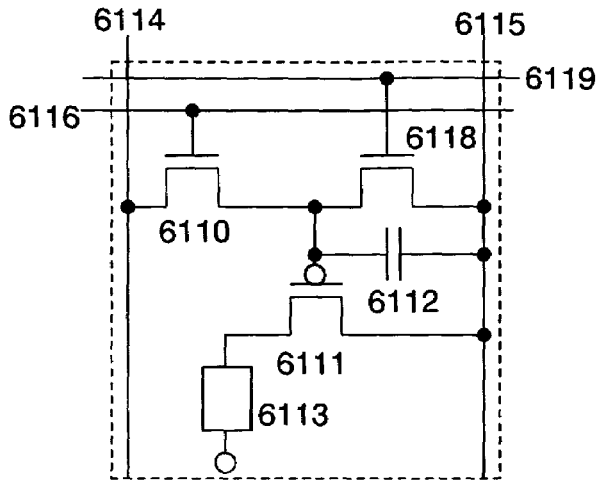
Figure 6C:
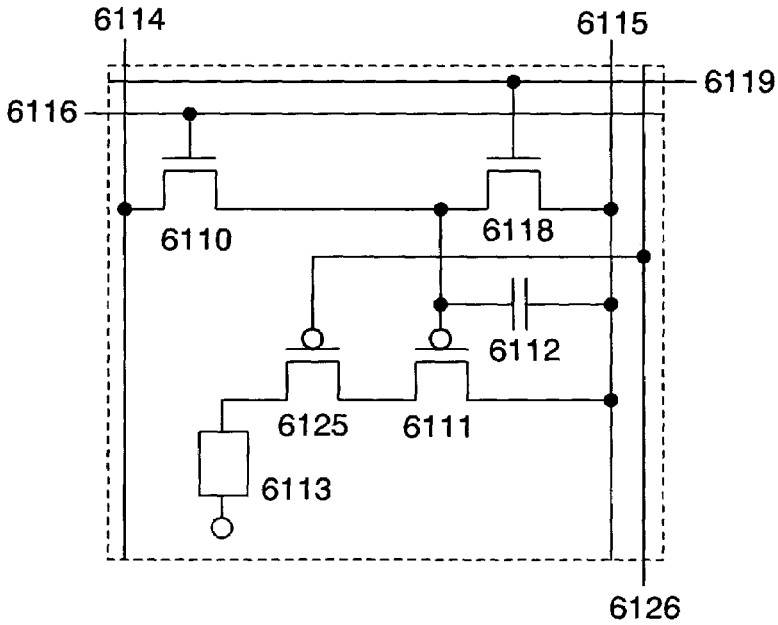

Next, a circuit diagram of a pixel in a light emitting device of the invention is described using FIGS. 6A to 6C.

FIG. 6A is an example of an equivalent circuit diagram of a pixel, which comprises a signal line 6114, a power supply line 6115, a scan line 6116, a light emitting element 6113, TFT's 6110 and 6111, and a capacitor 6112. The signal line 6114 is inputted with a video signal by a signal line driver circuit. The TFT 6110 can control supply of potential of the video signal to a gate of the TFT 6111 in accordance with a selection signal inputted into the scan line 6116. The TFT 6111 can control supply of current to the light emitting element 6113 in accordance with the potential of the video signal. The capacitor 6112 can hold gate-source voltage of the TFT 6111. It is to be noted that the capacitor 6112 is provided in FIG. 6A, however, it may be not provided if the gate capacitance of the TFT 6111 or the other parasitic capacitance are enough to hold the gate-source voltage.

FIG. 6B is an equivalent circuit diagram of a pixel where a TFT 6118 and a scan line 6119 are additionally provided in the pixel shown in FIG. 6A. By the TFT 6118, potential of the gate and the source of the TFT 6111 can be equal to each other to make no current flow into the light emitting element 6113 forcibly. Therefore, the period for each subframe period can be set to be shorter than a period for inputting a video signal into all pixels. Accordingly, display can be performed with the high total gray scale level while suppressing the drive frequency.

FIG. 6C is an equivalent circuit diagram of a pixel where a TFT 6125 and a wiring 6126 are additionally provided in the pixel shown in FIG. 6B. Gate potential of the TFT 6125 is stabilized by the wiring 6126. In addition, the TFTs 6111 and 6125 are connected in series between the power source line 6115 and the light emitting element 6113. Therefore, in FIG. 6C, the TFT 6125 controls the amount of current supplied to the light emitting element 6113 while the TFT 6111 controls whether the current is supplied or not to the light emitting element 6113.

It is to be noted that a configuration of a pixel in the light emitting device of the invention is not limited to those described in this embodiment. This embodiment can be freely combined with the above-described embodiment mode.

Embodiment 2

In this embodiment, timing of appearing each subframe period is described in the case of the driving method described in FIG. 4.

Figure 7:
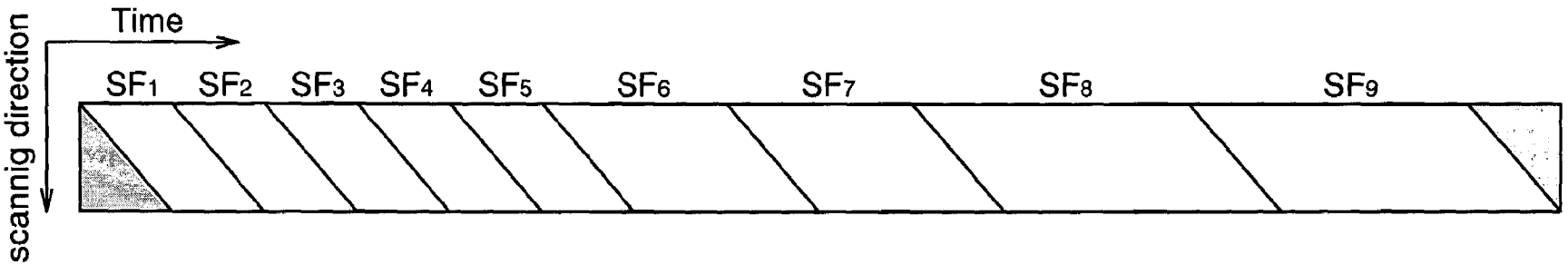
FIG. 7 is a timing chart in the case of displaying a 4-bit gray scale according to the driving method of the invention.

FIG. 7 is a timing chart for the case of a 4-bit gray scale display using the driving method shown in FIG. 4. In FIG. 7, the horizontal axis indicates the length of subframe periods $SF_1$ to $SF_9$ within one frame period, and the vertical axis indicates the selection sequence of scan lines. The length ratio of the subframe periods $SF_1$ to $SF_9$ is set to be 1:1:1:1:1:2:2:3:3 sequentially from $SF_1$.

When each subframe period starts, video signal input is performed per pixels for one row sharing the scan line. After the video signal is inputted into the pixel, a light emitting element emits light or no light in accordance with data of the video signal. The light emitting element in each pixel keeps the light emission or non-light emission in accordance with data of the video signal until the next subframe period starts.

It is to be noted that in the timing chart shown in FIG. 7, a light emitting element emit light or does not emit light in accordance with data of a video signal immediately after the video signal is inputted into a pixel, however, the invention is not limited to this structure. Alternatively, it is possible that the light emitting elements are kept to be the state of non-light emission during a period for inputting a video signal into all pixels, and after the video signal is inputted into all the pixels, the light emitting elements emit light or not in accordance with data of the video signal.

In addition, in the timing chart shown in FIG. 7, all subframe periods appear continuously, however, the invention is not limited to this structure. It is possible to provide a period for making forcibly a light emitting element emit no light (non-display period), between subframe periods. The non-display period may appear before or after video signal input into all pixels is completed in a subframe period right before the non-display period.

Embodiment 3

Figure 8A:
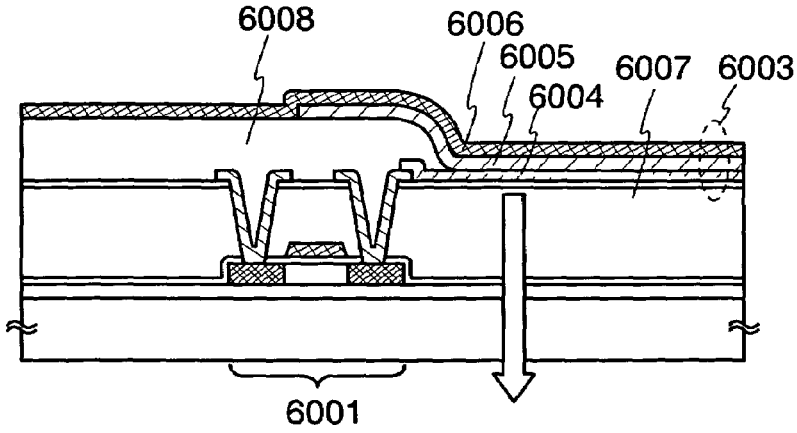
FIGS. 8A to 8C are cross-sectional views of a pixel in the light emitting device of the invention.
Figure 8B:
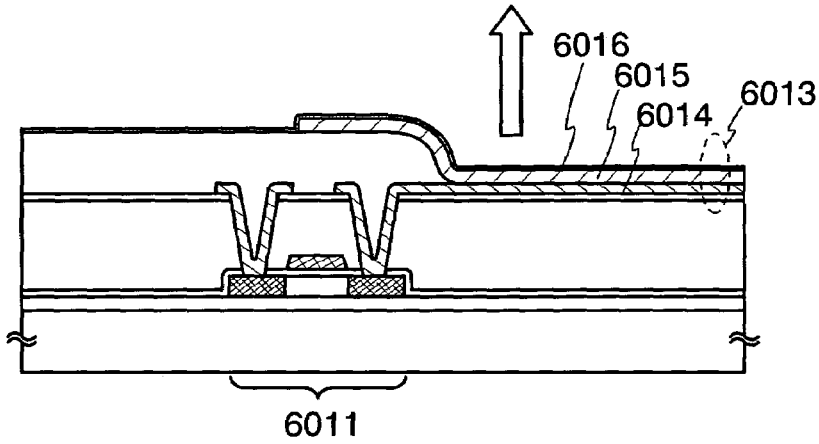
Figure 8C:
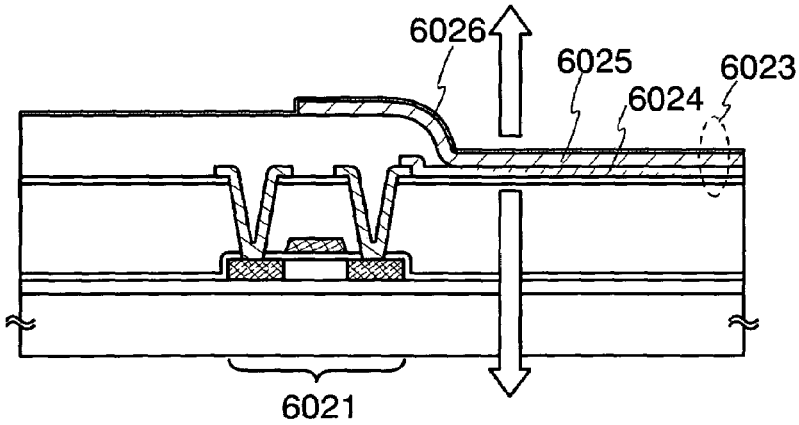

In this embodiment, a cross-sectional structure of a pixel where a transistor for controlling current supply to a light emitting element is a P-channel type is described using FIGS. 8A to 8C. Note that, in this specification, one of the anode and the cathode of the light emitting element, of which potential can be controlled by a transistor, is referred to as a first electrode, and the other is referred to as a second electrode. Description is made on the case where the first electrode is the anode and the second electrode is the cathode in FIGS. 8A to 8C, however, it is possible that the first electrode is the cathode while the second electrode is the anode as well.

FIG. 8A is a cross-sectional view of a pixel where a transistor 6001 is a P-channel type and light from a light emitting element 6003 is extracted from a first electrode 6004 side. The first electrode 6004 of the light emitting element 6003 is electrically connected to the transistor 6001 in FIG. 8A.

The transistor 6001 is covered with an interlayer insulating film 6007, and a bank 6008 having an opening is formed over the interlayer insulating film 6007. In the opening of the bank 6008, the first electrode 6004 is partially exposed, and the first electrode 6004, an electroluminescent layer 6005 and a second electrode 6006 are stacked in this order.

The interlayer insulating film 6007 can be formed by an organic resin film, an inorganic insulating film, or an insulating film containing a siloxane based material as a starting material and having Si—O—Si bonds (hereinafter referred to as a "siloxane insulating film"). Siloxane is composed of a skeleton formed by the bond of silicon (Si) and oxygen (O), in which an organic group containing at least hydrogen (such as an alkyl group or aromatic hydrocarbon) is included as a substituent. Alternatively, a fluoro group may be used as the substituent. Further alternatively, a fluoro group and an organic group containing at least hydrogen may be used as the substituent. The interlayer insulating film 6007 may also be formed using a so-called low dielectric constant material (low-k material).

The bank 6008 can be formed using an organic resin film, an inorganic insulating film, or a siloxane insulating film. In the case of an organic resin film, for example, acrylic, polyimide, or polyamide can be used, whereas in the case of an inorganic insulating film, silicon oxide, or silicon nitride oxide can be used. Preferably, the bank 6008 is formed using a photosensitive organic resin film and has an opening on the first electrode 6004 which is formed such that the side face thereof has a slope with a continuous curvature, which can prevent the first electrode 6004 and the second electrode 6006 from being short-circuited.

The first electrode 6004 is formed of a material or with a thickness enough to transmit light, and of a material suitable for being used as an anode. For example, the first electrode 6004 can be formed of indium tin oxide (ITO), zinc oxide (ZnO), indium zinc oxide (IZO), gallium-doped zinc oxide (GZO), or another light transmitting conductive oxide. Alternatively, the first electrode 6004 may be formed of a mixture of indium tin oxide containing ITO and silicon oxide (hereinafter referred to as ITSO) or indium oxide containing silicon oxide with zinc oxide (ZnO) of 2 to 20%. Further, other than the aforementioned light transmitting conductive oxides, the first electrode 6004 may be formed by using, for example, a single-layer film of one or more of TiN, ZrN, Ti, W, Ni, Pt, Cr, Ag, Al and the like, a laminated layer of a titanium nitride film and a film containing aluminum as a main component, or a three-layer structure of a titanium nitride film, a film containing aluminum as a main component and a titanium nitride film. However, when adopting a material other than the light transmitting conductive oxides, the first electrode 6004 is formed thick enough to transmit light (preferably about 5 to 30 nm).

The second electrode 6006 is formed of a material and with a thickness enough to reflect or shield light, and can be formed of a metal, an alloy, an electrically conductive compound each having a low work function, or a mixture of them. Specifically, an alkali metal such as Li and Cs, an alkaline earth metal such as Mg, Ca and Sr, an alloy containing such metals (Mg:Ag, Al:Li, Mg:In or the like), a compound of such metals ($CaF_2$ or CaN), or a rare-earth metal such as Yb and Er can be employed. When providing an electron injection layer, another conductive layer such as an Al layer can be employed as well.

The electroluminescent layer 6005 is structured by a single layer or a plurality of layers. In the case of a plurality of layers, these layers can be classified into a hole injection layer, a hole transporting layer, a light emitting layer, an electron transporting layer, an electron injection layer and the like in terms of the carrier transporting property. When the electroluminescent layer 6005 has any of the hole injection layer, the hole transporting layer, the electron transporting layer and the electron injection layer in addition to the light emitting layer, the hole injection layer, the hole transporting layer, the light emitting layer, the electron transporting layer and the electron injection layer are stacked in this order on the first electrode 6004. Note that the boundary between the layers is not necessarily distinct, and the boundary may not be distinguished clearly in some cases since the materials forming the respective layers are partially mixed. Each of the layers can be formed of an organic material or an inorganic material. As for an organic material, any of the high, medium and low molecular weight materials can be employed. Note that the medium molecular weight material means a low polymer in which the number of repeated structural units (the degree of polymerization) is about 2 to 20. There is no clear distinction between the hole injection layer and the hole transporting layer, and both of them inevitably have the hole transporting property (hole mobility). The hole injection layer is in contact with the anode, and a layer in contact with the hole injection layer is referred to as a hole transporting layer to be distinguished for convenience. The same are applied to the electron transporting layer and the electron injection layer. A layer in contact with the cathode is called an electron injection layer while a layer in contact with the electron injection layer is called an electron transporting layer. The light emitting layer may have the function of the electron transporting layer in some cases, and thus may be called a light emitting electron transporting layer.

In the pixel shown in FIG. 8A, light emitted from the light emitting element 6003 can be extracted from the first electrode 6004 side as shown by a hollow arrow.

FIG. 8B is a cross-sectional view of a pixel where a transistor 6011 is a P-channel type and light emitted from a light emitting element 6013 is extracted from a second electrode 6016 side. A first electrode 6014 of the light emitting element 6013 is electrically connected to the transistor 6011 in FIG. 8B. On the first electrode 6014, an electroluminescent layer 6015 and the second electrode 6016 are stacked in this order.

The first electrode 6014 is formed of a material and with a thickness enough to reflect or shield light, and formed of a material suitable for being used as an anode. For example, the first electrode 6014 may be formed by a single-layer film of one or more of TiN, ZrN, Ti, W, Ni, Pt, Cr, Ag, Al and the like, a laminated layer of a titanium nitride film and a film containing aluminum as a main component, or a three-layer structure of a titanium nitride film, a film containing aluminum as a main component and a titanium nitride film.

The second electrode 6016 is formed of a material or with a thickness enough to transmit light, and can be formed of a metal, an alloy, an electrically conductive compound each having a low work function or a mixture of them. Specifically, an alkali metal such as Li and Cs, an alkaline earth metal such as Mg, Ca and Sr, an alloy containing such metals (Mg:Ag, Al:Li, Mg:In or the like), a compound of such metals ($CaF_2$ or CaN), or a rare-earth metal such as Yb and Er can be employed. When providing an electron injection layer, another conductive layer such as an Al layer can be employed as well. Moreover, the second electrode 6016 is formed thick enough to transmit light (preferably about 5 to 30 nm). Note that the second electrode 6016 may be formed of another light transmitting conductive oxide such as indium tin oxide (ITO), zinc oxide (ZnO), indium zinc oxide (IZO), and gallium-doped zinc oxide (GZO). Alternatively, a mixture of indium tin oxide containing ITO and silicon oxide (ITSO) or indium oxide containing silicon oxide and zinc oxide (ZnO) of 2 to 20% may be employed. In the case of adopting a light transmitting conductive oxide, an electron injection layer is preferably provided in the electroluminescent layer 6015.

The electroluminescent layer 6015 can be formed similarly to the electroluminescent layer 6005 shown in FIG. 8A.

In the pixel shown in FIG. 8B, light emitted from the light emitting element 6013 can be extracted from the second electrode 6016 side as shown by a hollow arrow.

FIG. 8C is a cross-sectional view of a pixel where a transistor 6021 is a P-channel type and light emitted from a light emitting element 6023 is extracted from both of a first electrode 6024 side and a second electrode 6026 side. The first electrode 6024 of the light emitting element 6023 is electrically connected to the transistor 6021 in FIG. 8C. On the first electrode 6024, an electroluminescent layer 6025 and the second electrode 6026 are stacked in this order.

The first electrode 6024 can be formed similarly to the first electrode 6004 shown in FIG. 8A while the second electrode 6026 can be formed similarly to the second electrode 6016 shown in FIG. 8B. The electroluminescent layer 6025 can be formed similarly to the electroluminescent layer 6005 shown in FIG. 8A.

In the pixel shown in FIG. 8C, light emitted from the light emitting element 6023 can be extracted from both of the first electrode 6024 side and the second electrode 6026 side as shown by hollow arrows.

This embodiment can be freely combined with any of the above-described embodiment mode and Embodiments.

Embodiment 4

Figure 9A:
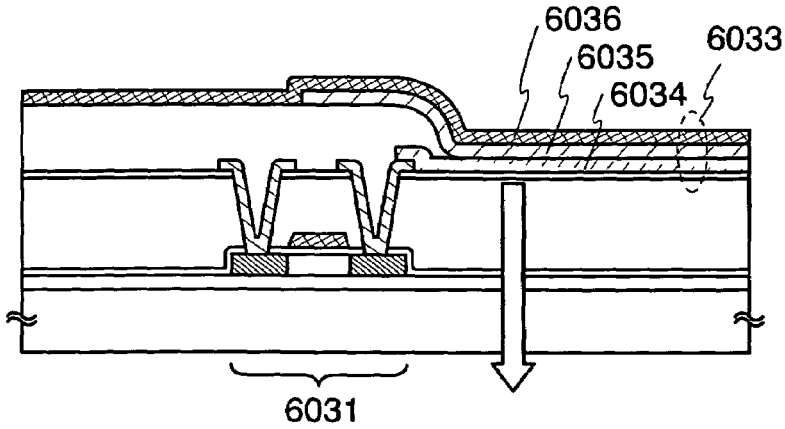
FIGS. 9A to 9C are cross-sectional views of a pixel in the light emitting device of the invention.
Figure 9B:
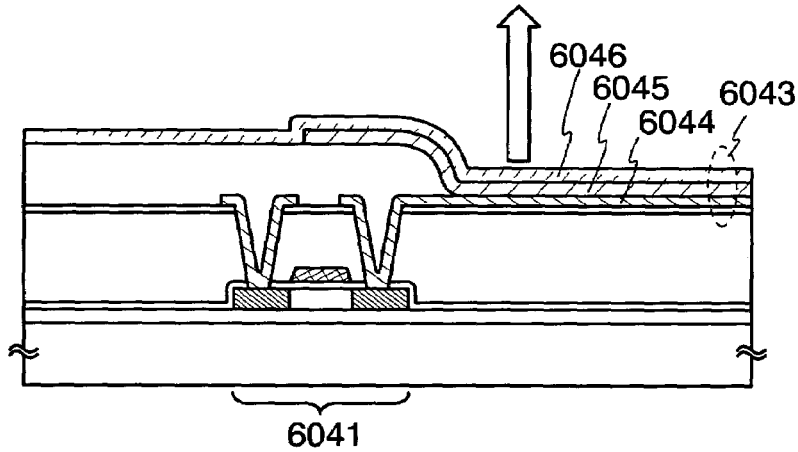
Figure 9C:
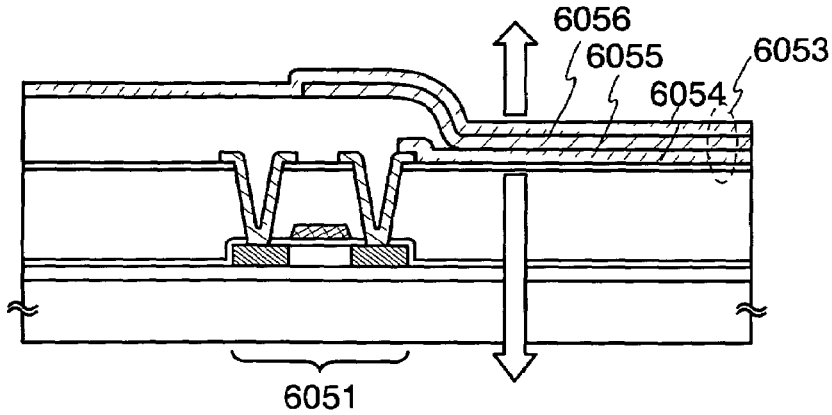

In this embodiment, a cross-sectional structure of a pixel where a transistor is an N-channel type is described using FIGS. 9A to 9C. Note that a first electrode is a cathode while a second electrode is an anode in FIGS. 9A to 9C, however, it is possible that the first electrode is an anode while the second electrode is a cathode as well.

FIG. 9A is a cross-sectional view of a pixel where a transistor 6031 is an N-channel type and light emitted from a light emitting element 6033 is extracted from a first electrode 6034 side. The first electrode 6034 of the light emitting element 6033 is electrically connected to the transistor 6031 in FIG. 9A. On the first electrode 6034, an electroluminescent layer 6035 and a second electrode 6036 are stacked in this order.

The first electrode 6034 is formed of a material or with a thickness enough to transmit light, and can be formed of a metal, an alloy, an electrically conductive compound each having a low work function, or a mixture of them. Specifically, an alkali metal such as Li and Cs, an alkaline earth metal such as Mg, Ca and Sr, an alloy containing such metals (Mg:Ag, Al:Li, Mg:In or the like), a compound of such metals ($CaF_2$ or CaN), or a rare-earth metal such as Yb and Er can be employed. When providing an electron injection layer, another conductive layer such as an Al layer can be employed as well. Moreover, the first electrode 6034 is formed thick enough to transmit light (preferably about 5 to 30 nm). In addition, a light transmitting conductive layer may be additionally formed using light transmitting conductive oxide so as to contact with the top or bottom of the aforementioned conductive layer having a thickness enough to transmit light in order to suppress the sheet resistance of the first electrode 6034. Note that the first electrode 6034 may be formed by using only a conductive layer employing indium tin oxide (ITO), zinc oxide (ZnO), indium zinc oxide (IZO), gallium-doped zinc oxide (GZO), or another light transmitting conductive oxide. Alternatively, a mixture of indium tin oxide containing ITO and silicon oxide (ITSO) or indium oxide containing silicon oxide with zinc oxide (ZnO) of 2 to 20% may be employed. In the case of adopting a light transmitting conductive oxide, an electron injection layer is preferably provided in the electroluminescent layer 6035.

The second electrode 6036 is formed of a material and with a thickness enough to reflect or shield light, and formed of a material suitable for being used as an anode. For example, the second electrode 6036 may be formed by a single-layer film of one or more of TiN, ZrN, Ti, W, Ni, Pt, Cr, Ag, Al and the like, a laminated layer of a titanium nitride film and a film containing aluminum as a main component, or a three-layer structure of a titanium nitride film, a film containing aluminum as a main component and a titanium nitride film.

The electroluminescent layer 6035 can be formed similarly to the electroluminescent layer 6005 shown in FIG. 8A. In the case where the electroluminescent layer 6035 has any of the hole injection layer, the hole transporting layer, the electron transporting layer and the electron injection layer in addition to the light emitting layer, the electron injection layer, the electron transporting layer, the light emitting layer, the hole transporting layer and the hole injection layer are stacked in this order on the first electrode 6034.

In the pixel shown in FIG. 9A, light emitted from the light emitting element 6033 can be extracted from the first electrode 6034 side as shown by a hollow arrow.

FIG. 9B is a cross-sectional view of a pixel where a transistor 6041 is an N-channel type and light emitted from a light emitting element 6043 is extracted from a second electrode 6046 side. A first electrode 6044 of the light emitting element 6043 is electrically connected to the transistor 6041 in FIG. 9B. On the first electrode 6044, an electroluminescent layer 6045 and the second electrode 6046 are stacked in this order.

The first electrode 6044 is formed of a material and with a thickness enough to reflect or shield light, and can be formed of a metal, an alloy, an electrically conductive compound each having a low work function, a mixture of them, or the like. Specifically, an alkali metal such as Li and Cs, an alkaline earth metal such as Mg, Ca and Sr, an alloy containing such metals (Mg:Ag , Al:Li, Mg:In or the like), a compound of such metals ($CaF_2$ or CaN), or a rare-earth metal such as Yb and Er can be employed. When providing an electron injection layer, another conductive layer such as an Al layer can be employed as well.

The second electrode 6046 is formed of a material or with a thickness enough to transmit light, and formed of a material suitable for being used as an anode. For example, the second electrode 6046 can be formed of indium tin oxide (ITO), zinc oxide (ZnO), indium zinc oxide (IZO), gallium-doped zinc oxide (GZO), or another light transmitting conductive oxide. Alternatively, the second electrode 6046 may be formed of a mixture of indium tin oxide containing ITO and silicon oxide (ITSO) or indium oxide containing silicon oxide with zinc oxide (ZnO) of 2 to 20%. Further, other than the aforementioned light transmitting conductive oxides, the second electrode 6046 may be formed by, for example, a single-layer film of one or more of TiN, ZrN, Ti, W, Ni, Pt, Cr, Ag, and Al, a laminated layer of a titanium nitride film and a film containing aluminum as a main component, or a three-layer structure of a titanium nitride film, a film containing aluminum as a main component and a titanium nitride film. However, when adopting a material other than the light transmitting conductive oxides, the second electrode 6046 is formed thick enough to transmit light (preferably about 5 to 30 nm).

The electroluminescent layer 6045 can be formed similarly to the electroluminescent layer 6035 shown in FIG. 9A.

In the pixel shown in FIG. 9B, light emitted from the light emitting element 6043 can be extracted from the second electrode 6046 side as shown by a hollow arrow.

FIG. 9C is a cross-sectional view of a pixel where a transistor 6051 is an N-channel type and light emitted from a light emitting element 6053 is extracted from both of a first electrode 6054 side and a second electrode 6056 side. The first electrode 6054 of the light emitting element 6053 is electrically connected to the transistor 6051 in FIG. 9C. On the first electrode 6054, an electroluminescent layer 6055 and the second electrode 6056 are stacked in this order.

The first electrode 6054 can be formed similarly to the first electrode 6034 shown in FIG. 9A while the second electrode 6056 can be formed similarly to the second electrode 6046 shown in FIG. 9B. The electroluminescent layer 6055 can be formed similarly to the electroluminescent layer 6035 shown in FIG. 9A.

In the pixel shown in FIG. 9C, light emitted from the light emitting element 6053 can be extracted from both of the first electrode 6054 side and the second electrode 6056 side as shown by hollow arrows.

This embodiment can be freely combined with any of the above-described embodiment mode and Embodiments.

Embodiment 5

The light emitting device of the invention can be manufactured by a printing method typified by screen printing and offset printing, or a droplet discharging method. The droplet discharging method is a method for forming a predetermined pattern by discharging droplets containing a predetermined composition from a minute hole, which includes an ink-jet method. When using such a printing method or a droplet discharging method, various wirings typified by a signal line, a scan line, and a selection line, a gate of a TFT, an electrode of a light emitting element, and the like can be formed without employing an exposure mask. However, the printing method or the droplet discharging method is not necessarily used for the all steps of forming patterns. Therefore, such a process is possible that wirings and a gate are formed by a printing method or a droplet discharging method while a semiconductor film is patterned by a lithography method, in which the printing method or the droplet discharging method are used for a part of the process, and a lithography method is additionally used. Note that a mask for patterning may be formed by a printing method or a droplet discharging method.

Figure 10:
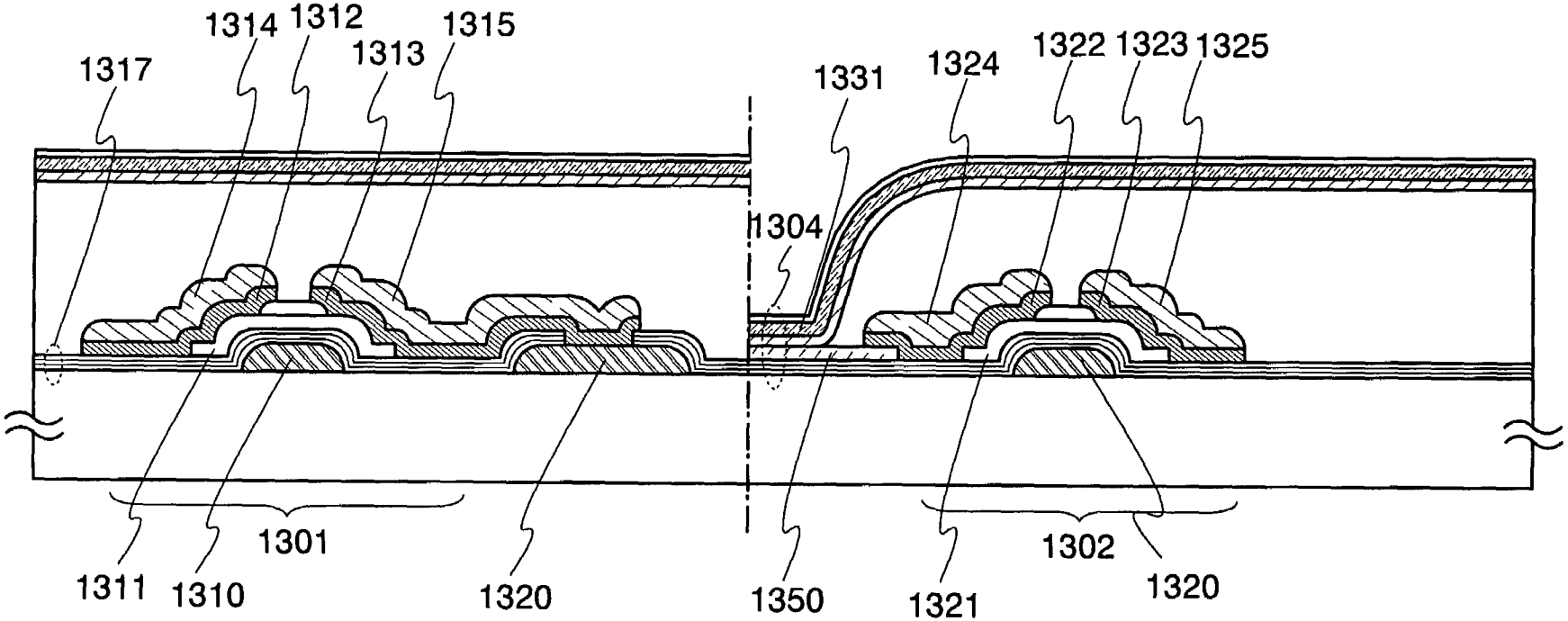
FIG. 10 is a cross-sectional view of a pixel in the light emitting device of the invention.

FIG. 10 is an exemplary cross-sectional view of a light emitting device of the invention formed using a droplet discharging method. In FIG. 10, reference numerals 1301 and 1302 each denotes a transistor, and 1304 denotes a light emitting element. Note that the transistor 1302 is electrically connected to a first electrode 1350 of the light emitting element 1304. The transistor 1302 is preferably an N-channel type, and in this case, it is preferable that the first electrode 1350 is a cathode while a second electrode 1331 is an anode.

The transistor 1301 to function as a switching element has a gate 1310, a first semiconductor film 1311 including a channel formation region, a gate insulating film 1317 formed between the gate 1310 and the first semiconductor film 1311, second semiconductor films 1312 and 1313 to function as a source or a drain, a wiring 1314 connected to the second semiconductor film 1312, and a wiring 1315 connected to the second semiconductor film 1313.

The transistor 1302 has a gate 1320, a first semiconductor film 1321 including a channel formation region, the gate insulating film 1317 formed between the gate 1320 and the first semiconductor film 1321, second semiconductor films 1322 and 1323 to function as a source or a drain, a wiring 1324 connected to the second semiconductor film 1322, and a wiring 1325 connected to the second semiconductor film 1323.

The wiring 1314 corresponds to a signal line, and the wiring 1315 is electrically connected to the gate 1320 of the transistor 1302. The wiring 1325 corresponds to a power supply line.

By forming patterns using a droplet discharging method or a printing method, a series of steps for a lithography method that includes photoresist formation, exposure, development, etching, and peeling can be simplified. In addition, when adopting the droplet discharging method or the printing method, waste of materials that would be removed by etching can be avoided unlike the case of adopting a lithography method. Further, since an expensive mask for exposure is not required, manufacturing cost of the light emitting device can be suppressed.

In addition, differently from a lithography method, etching is not required in order to form wirings. Accordingly, a step of forming wirings can be completed in an extremely shorter time than the case of the lithography method. In particular, when the wiring is formed with a thickness of 0.5 μm or more, nd more preferably 2 μm or more, the wiring resistance can be suppressed, therefore, the increase of the wiring resistance along with enlargement of the light emitting device can be suppressed while suppressing time required for the step of forming wirings.

Note that the first semiconductor films 1311 and 1321 may be either an amorphous semiconductor or a semi-amorphous semiconductor (SAS).

Amorphous semiconductors can be obtained by decomposing a silicide gas by glow discharge. As the typical silicide gas, $SiH_4$ or $Si_2H_6$ can be employed. The silicide gas may be diluted with hydrogen, or hydrogen and helium.

Similarly, SAS can be obtained by decomposing a silicide gas by glow discharge. As the typical silicide gas, $SiH_4$ can be used in addition to $Si_2H_6$, $SiH_2Cl_2$, $SiHCl_3$, $SiCl_4$, $SiF_4$, or the like. SAS can be formed easily by diluting the silicide gas with a hydrogen gas or a mixed gas of hydrogen and one or more of a rare-gas element selected among helium, argon, krypton and neon. The silicide gas is preferably diluted at a rate of 1:2 to 1:1000. Further, the silicide gas may be mixed with a carbon gas such as $CH_4$ and $C_2H_6$, a germanium gas such as $GeH_4$ and $GeF_4$, or $F_2$ so that the energy bandwidth is controlled to be 1.5 to 2.4 eV, or 0.9 to 1.1 eV. A TFT using SAS as the first semiconductor film can exhibit the mobility of 1 to 10 $cm^2$/Vsec or more.

In addition, the first semiconductor films 1311 and 1321 may be formed using a semiconductor obtained by crystallizing an amorphous semiconductor or a semi-amorphous semiconductor (SAS) with laser.

This embodiment can be freely combined with any of the above-described embodiment mode and Embodiments.

Embodiment 6

Figure 11A:
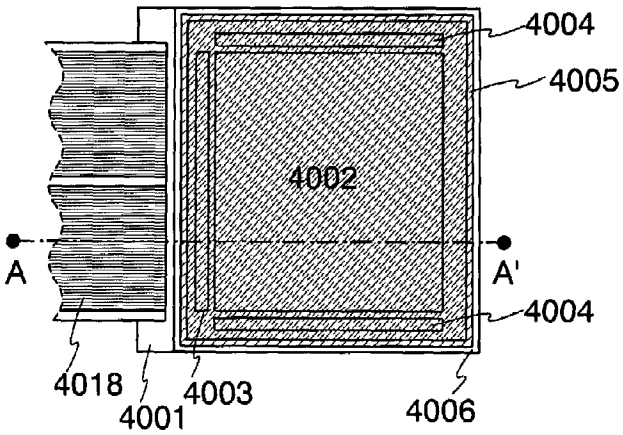
FIG. 11A is a top plan view and FIG. 11B is a cross-sectional view of the light emitting device of the invention respectively.
Figure 11B:
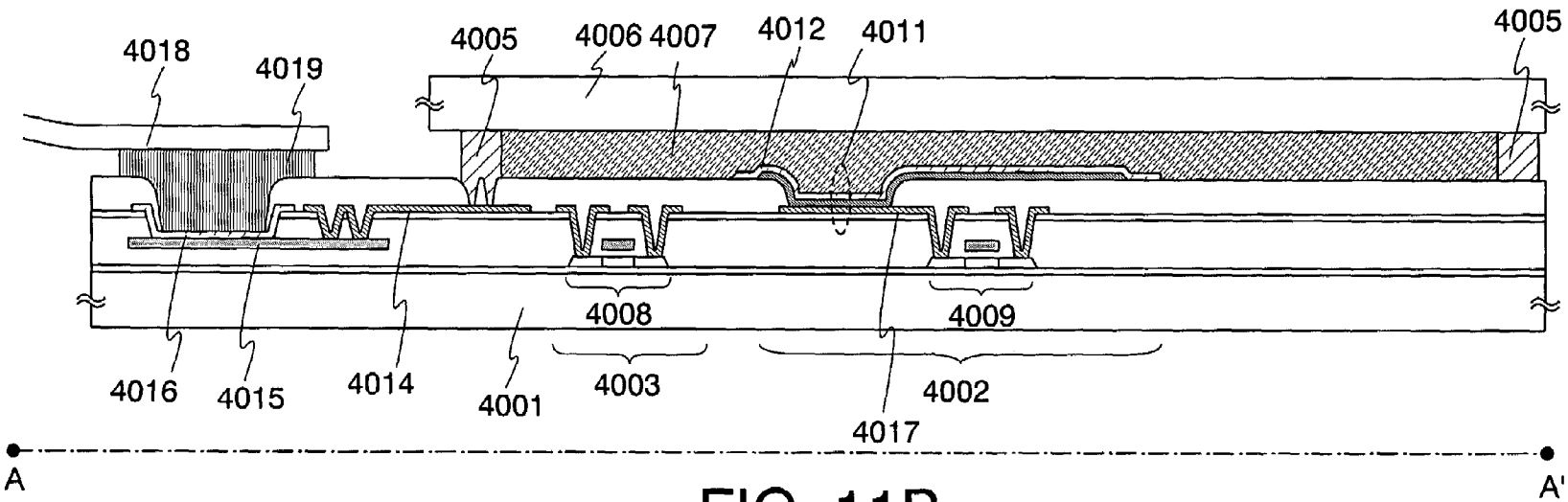

In this embodiment, description is made on an exterior view of a panel which corresponds to one mode of a light emitting device of the invention with reference to FIGS. 11A and 11B. FIG. 11A is a top view of a panel where transistors and light emitting elements formed over a first substrate are sealed with a sealant between the first substrate and a second substrate. FIG. 11B is a cross-sectional view of FIG. 11A taken along a line A-A'.

A sealant 4005 is provided so as to surround a pixel portion 4002, a signal line driver circuit 4003 and a scan line driver circuit 4004 formed over a first substrate 4001. In addition, a second substrate 4006 is provided thereover. Accordingly, the pixel portion 4002, the signal line driver circuit 4003, and the scan line driver circuit 4004 are tightly sealed by the first substrate 4001, the sealant 4005 and the second substrate 4006 together with a filler 4007.

The pixel portion 4002, the signal line driver circuit 4003, and the scan line driver circuit 4004 formed over the first substrate 4001 each includes a plurality of transistors. In FIG. 11B, a transistor 4008 in the signal line driver circuit 4003, and a transistor 4009 in the pixel portion 4002 are illustrated.

Reference numeral 4011 denotes a light emitting element, and a wiring 4017 connected to a drain of the transistor 4009 functions partially as a first electrode of the light emitting element 4011. A transparent conductive film 4012 functions as a second electrode of the light emitting element 4011. Note that the light emitting element 4011 is not limited to the structure described in this embodiment, and the structure of the light emitting element 4011 can be appropriately changed in accordance with the extraction direction of light emitted from the light emitting element 4011, the conductivity of the transistor 4009, and the like.

Various signals and voltage supplied to the signal line driver circuit 4003, the scan line driver circuit 4004 and the pixel portion 4002 are supplied from a connecting terminal 4016 via lead wirings 4014 and 4015 although not shown in the cross-sectional view in FIG. 11B.

In this embodiment, the connecting terminal 4016 is formed using the same conductive film as the first electrode of the light emitting element 4011. The lead wiring 4014 is formed using the same conductive film as the wiring 4017. The lead wiring 4015 is formed using the same conductive film as respective gates of the transistors 4009 and 4008.

The connecting terminal 4016 is electrically connected to a terminal of an FPC 4018 through an anisotropic conductive film 4019.

It is to be noted that the first substrate 4001 and the second substrate 4006 may be each formed of glass, metal (typically, stainless), ceramics, or plastics. As for the plastic, an FRP (Fiberglass-Reinforced Plastics) substrate, a PVF (Polyvinylfluoride) film, a mylar film, a polyester film or an acrylic resin film can be employed. In addition, a sheet having a structure that aluminum is sandwiched by a PVF film or a mylar film can be employed as well.

Note that the second substrate 4006 is required to transmit light since it is disposed on the side from which light emitted from the light emitting element 4011 is extracted. In this case, a light transmitting material is employed such as a glass plate, a plastic plate, a polyester film and an acrylic film.

As for the filler 4007, an inert gas such as nitrogen and argon, an ultraviolet curable resin or a heat curable resin can be used, and for example, PVC (polyvinyl chloride), acrylic, polyimide, an epoxy resin, a silicone resin, PVB (polyvinyl butyral) or EVA (ethylene vinyl acetate) can be used. In this embodiment, nitrogen is employed as the filler.

This embodiment can be freely combined with any of the above-described embodiment mode and Embodiments.

Embodiment 7

The semiconductor display device of the invention can suppress generation of a pseudo contour even if the hand jiggles, which is suitable for display portions of portable electronic apparatuses such as a portable phone, a portable game machine or electronic book, a camera such as a video camera, and a digital still camera that are used while being sustained by the hand. In addition, since the semiconductor display device of the invention can prevent a pseudo contour, the invention is suitable for electronic apparatuses having a display portion, such as a display device by which moving images can be played and images can be enjoyed.

Further, the semiconductor display device of the invention can be applied to electronic apparatuses such as a camera such as a video camera and a digital camera, a goggle type display (head mounted display), a navigation system, a sound reproducing device (car audio system, audio component system and the like), a notebook personal computer, a game machine, an image reproducing device equipped with a recording medium (typically, a device reproducing a recording medium such as DVD (Digital Versatile Disk) and having a display for displaying the reproduced image). Specific examples of such electronic apparatuses are illustrated in FIGS. 12A to 12C.

Figure 12A:
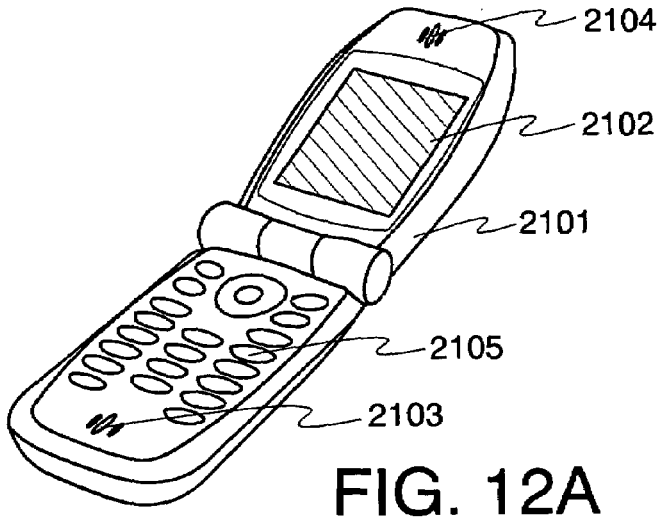
FIGS. 12A to 12C are views of electronic apparatuses each using the light emitting device of the invention.

FIG. 12A illustrates a portable phone which includes a main body 2101, a display portion 2102, an audio input portion 2103, an audio output portion 2104, and an operating key 2105. A portable phone that is one of the electronic apparatuses of the invention can be completed by forming the display portion 2102 using the semiconductor display device of the invention.

Figure 12B:
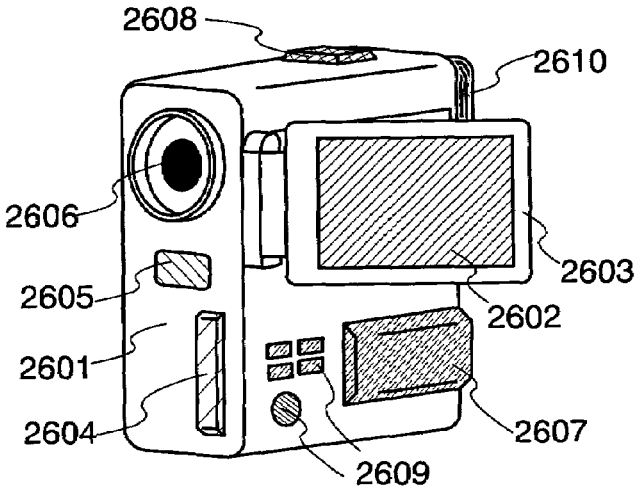

FIG. 12B illustrates a video camera which includes a main body 2601, a display portion 2602, a housing 2603, an external connection port 2604, a remote control receiving portion 2605, an image receiving portion 2606, a battery 2607, an audio input portion 2608, operating keys 2609, and an eye piece portion 2610. A video camera that is one of the electronic apparatuses of the invention can be completed by forming the display portion 2602 using the semiconductor display device of the invention.

Figure 12C:
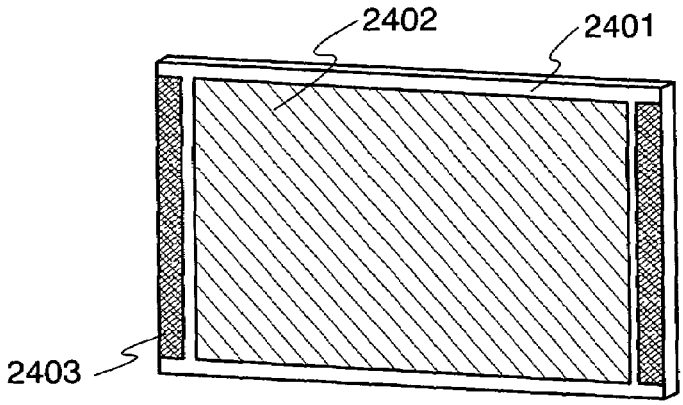

FIG. 12C illustrates a display device which includes a housing 2401, a display portion 2402, and a speaker portion 2403. A display device that is one of the electronic apparatuses of the invention can be completed by forming the display portion 2402 using the semiconductor display device of the invention. Note that the display device includes any display device for displaying information such as for a personal computer, for receiving TV broadcast, and for displaying advertisement.

As set forth above, the application range of the invention is so wide that it can be applied to electronic apparatuses in various fields. This embodiment can be freely combined with the above-described embodiment mode and Embodiments.

This application is based on Japanese Patent Application serial no. 2004-147874 filed in Japan Patent Office on 18, May, 2004 and Japanese Patent Application serial no. 2004-187673 filed in Japan Patent Office on 25, Jun., 2004, and the entire contents of which are hereby incorporated by reference.

What is claimed is:

1. A semiconductor display device comprising:

a table in which a relationship between a gray scale level of a video signal and a subframe period for light emission is stored;

a controller for converting the video signal in accordance with the table; and a panel of which a pixel gray scale level is controlled by the converted video signal, wherein the subframe period for light emission is determined based on a subframe ratio $R_{SF}$, and wherein the subframe ratio $R_{SF}$ is calculated based on a sharing ratio $R_{sh}$ determined by a frame frequency.

2. A semiconductor display device comprising:

a table in which a relationship between a gray scale level of a video signal and a subframe period for light emission is stored;

a controller for converting the video signal in accordance with the table; and a panel of which a pixel gray scale level is controlled by the converted video signal, wherein the subframe period for light emission is determined based on a subframe ratio $R_{SF}$, and wherein the subframe ratio $R_{SF}$ and a sharing ratio $R_{sh}$ determined by a frame frequency satisfy $R_{SF}=(1-R_{sh})/(2-R_{sh})$.

3. A semiconductor display device comprising:

a table in which a relationship between a gray scale level of a video signal and a subframe period for light emission is stored;

a controller for converting the video signal in accordance with the table; and a panel of which a pixel gray scale level is controlled by the converted video signal, wherein the subframe period for light emission is determined based on a subframe ratio $R_{SF}$ in middle and highest gray scale groups when a total gray scale level is equally divided into three, and wherein the subframe ratio $R_{SF}$ is calculated based on a sharing ratio $R_{sh}$ determined by a frame frequency.

4. A semiconductor display device comprising:

a table in which a relationship between a gray scale level of a video signal and a subframe period for light emission is stored;

a controller for converting the video signal in accordance with the table; and a panel of which a pixel gray scale level is controlled by the converted video signal, wherein the subframe period for light emission is determined based on a subframe ratio $R_{SF}$ in middle and highest gray scale groups when a total gray scale level is equally divided into three, and wherein the subframe ratio $R_{SF}$ and a sharing ratio $R_{sh}$ determined by a frame frequency satisfy $R_{SF}=(1-R_{sh})/(2-R_{sh})$.

5. A method of driving a semiconductor display device comprising:

dividing one frame period into a plurality of subframe periods;

calculating a subframe ratio $R_{SF}$ in accordance with a sharing ratio $R_{sh}$ determined by a frame frequency; and determining a subframe period for light emission in the plurality of subframe periods based on the subframe ratio $R_{SF}$.

6. A method of driving a semiconductor display device comprising:

dividing one frame period into a plurality of subframe periods;

calculating a subframe ratio $R_{SF}$ in accordance with a sharing ratio $R_{sh}$ determined by a frame frequency; and determining a subframe period for light emission in the plurality of subframe periods based on the subframe ratio $R_{SF}$, wherein the subframe ratio $R_{SF}$ and the sharing ratio $R_{sh}$ satisfy $R_{SF}=(1-R_{sh})/(2-R_{sh})$.

7. A method of driving a semiconductor display device comprising:

dividing one frame period into a plurality of subframe periods;

calculating a subframe ratio $R_{SF}$ in accordance with a sharing ratio $R_{sh}$ determined by a frame frequency; and determining a subframe period for light emission in the plurality of subframe periods based on the subframe ratio $R_{SF}$ in middle and highest gray scale groups when a total gray scale level is equally divided into three.

8. A method of driving a semiconductor display device comprising:

dividing one frame period into a plurality of subframe periods;

calculating a subframe ratio $R_{SF}$ in accordance with a sharing ratio $R_{sh}$ determined by a frame frequency; and determining a subframe period for light emission in the plurality of subframe periods based on the subframe ratio $R_{SF}$ in middle and highest gray scale groups when a total gray scale level is equally divided into three, wherein the subframe ratio $R_{SF}$ and the sharing ratio $R_{sh}$ satisfy $R_{SF}=(1-R_{sh})/(2-R_{sh})$.

9. The semiconductor display device according to claim 1, wherein the semiconductor display device is incorporated into an electronic apparatus selected from the group consisting of a camera such as a digital camera and a video camera, a goggle type display, a navigation system, a sound reproducing device, a computer such as a mobile computer and a desktop computer, a game machine, a display device, a portable phone and an image reproducing device equipped with a recording medium.

10. The semiconductor display device according to claim 2, wherein the semiconductor display device is incorporated into an electronic apparatus selected from the group consisting of a camera such as a digital camera and a video camera, a goggle type display, a navigation system, a sound reproducing device, a computer such as a mobile computer and a desktop computer, a game machine, a display device, a portable phone and an image reproducing device equipped with a recording medium.

11. The semiconductor display device according to claim 3, wherein the semiconductor display device is incorporated into an electronic apparatus selected from the group consisting of a camera such as a digital camera and a video camera, a goggle type display, a navigation system, a sound reproducing device, a computer such as a mobile computer and a desktop computer, a game machine, a display device, a portable phone and an image reproducing device equipped with a recording medium.

12. The semiconductor display device according to claim 4, wherein the semiconductor display device is incorporated into an electronic apparatus selected from the group consisting of a camera such as a digital camera and a video camera, a goggle type display, a navigation system, a sound reproducing device, a computer such as a mobile computer and a desktop computer, a game machine, a display device, a portable phone and an image reproducing device equipped with a recording medium.

13. A semiconductor display device comprising:

a table in which a relationship between a gray scale level of a video signal and a subframe period for light emission is stored;

a controller for generating a control signal in accordance with the table; and a panel of which a pixel gray scale level is controlled by the control signal, wherein the subframe period for light emission is determined based on a subframe ratio $R_{SF}$, and wherein the subframe ratio $R_{SF}$ is calculated based on a sharing ratio $R_{sh}$ determined by a frame frequency.

14. A semiconductor display device comprising:

a table in which a relationship between a gray scale level of a video signal and a subframe period for light emission is stored;

a controller for generating a control signal in accordance with the table; and a panel of which a pixel gray scale level is controlled by the control signal, wherein the subframe period for light emission is determined based on a subframe ratio $R_{SF}$, and wherein the subframe ratio $R_{SF}$ and a sharing ratio $R_{sh}$ determined by a frame frequency satisfy $R_{SF}=(1-R_{sh})/(2-R_{sh})$.

15. The semiconductor display device according to claim 13, wherein the semiconductor display device is incorporated into an electronic apparatus selected from the group consisting of a camera such as a digital camera and a video camera, a goggle type display, a navigation system, a sound reproducing device, a computer such as a mobile computer and a desktop computer, a game machine, a display device, a portable phone and an image reproducing device equipped with a recording medium.

16. The semiconductor display device according to claim 14, wherein the semiconductor display device is incorporated into an electronic apparatus selected from the group consisting of a camera such as a digital camera and a video camera, a goggle type display, a navigation system, a sound reproducing device, a computer such as a mobile computer and a desktop computer, a game machine, a display device, a portable phone and an image reproducing device equipped with a recording medium.

17. The semiconductor display device according to claim 1, wherein the semiconductor display device is one selected from the group consisting of a light emitting device, a liquid crystal display device, a digital micromirror device, a plasma display panel and a field emission display.

18. The semiconductor display device according to claim 2, wherein the semiconductor display device is one selected from the group consisting of a light emitting device, a liquid crystal display device, a digital micromirror device, a plasma display panel and a field emission display.

19. The semiconductor display device according to claim 3, wherein the semiconductor display device is one selected from the group consisting of a light emitting device, a liquid crystal display device, a digital micromirror device, a plasma display panel and a field emission display.

20. The semiconductor display device according to claim 4, wherein the semiconductor display device is one selected from the group consisting of a light emitting device, a liquid crystal display device, a digital micromirror device, a plasma display panel and a field emission display.

21. The semiconductor display device according to claim 13, wherein the semiconductor display device is one selected from the group consisting of a light emitting device, a liquid crystal display device, a digital micromirror device, a plasma display panel and a field emission display.

22. The semiconductor display device according to claim 14, wherein the semiconductor display device is one selected from the group consisting of a light emitting device, a liquid crystal display device, a digital micromirror device, a plasma display panel and a field emission display.

* * * * *